US008104101B2

(12) United States Patent
Nocente et al.

(10) Patent No.: US 8,104,101 B2
(45) Date of Patent: Jan. 31, 2012

(54) INTEGRATED PROTECTIVE ENSEMBLE

(75) Inventors: Anna Marie Nocente, Somerville, MA (US); Marlene A. Devine, Andover, MA (US); John F. Stokes, Lawrence, MA (US); Kristine Drobot Isherwood, Boston, MA (US)

(73) Assignee: Tiax LLC, Lexington, MA (US)

( * ) Notice: Subject to any disclaimer, the term of this patent is extended or adjusted under 35 U.S.C. 154(b) by 1171 days.

(21) Appl. No.: 11/728,203

(22) Filed: Mar. 23, 2007

(65) Prior Publication Data

US 2007/0289050 A1 Dec. 20, 2007

Related U.S. Application Data

(60) Provisional application No. 60/785,568, filed on Mar. 24, 2006.

(51) Int. Cl.
*A41D 13/00* (2006.01)

(52) U.S. Cl. ..... 2/456

(58) Field of Classification Search ..... 2/81, 456, 2/457–458, 2.11, 2.15, 2.16, 2.17, 69, 82, 2/87, 69.5

See application file for complete search history.

(56) References Cited

U.S. PATENT DOCUMENTS

| | | | | | |
|---|---|---|---|---|---|
| 2,853,758 | A * | 9/1958 | Topf | 24/389 |
| 3,493,972 | A * | 2/1970 | Oldham | 2/2.17 |
| 3,643,264 | A * | 2/1972 | Rector | 2/2.17 |
| 3,771,169 | A * | 11/1973 | Edmund | 2/2.17 |
| 4,242,769 | A * | 1/1981 | Rayfield et al. | 441/91 |
| 4,464,795 | A * | 8/1984 | Long et al. | 2/2.17 |
| 5,191,658 | A * | 3/1993 | Meistrell | 2/2.17 |
| 5,245,993 | A | 9/1993 | McGrady et al. | |
| 6,415,440 | B1 * | 7/2002 | Stinton | 2/2.17 |
| 7,013,489 | B1 | 3/2006 | McGrath | |

* cited by examiner

*Primary Examiner* — Tejash Patel
(74) *Attorney, Agent, or Firm* — Nicole Palmer; Lando & Anastasi

(57) ABSTRACT

An integrated ensemble for personal protection and comfort. The integrated ensemble may generally include one or more multifunctional layers. Each layer may include functionality directed to provision of specific types of protection and/or personal comfort. A liner may be generally capable of providing immersion protection, cooling, and cold weather protection. A shell may be designed for wear in cooperation with the liner. The shell may be capable of providing protection against flame, acceleration, and other environmental factors, as well as providing cooling and gear carriage. The disclosed integrated ensembles are generally low-bulk to facilitate movement.

39 Claims, 18 Drawing Sheets

Subject 1; 6 Gz for 15 sec.

Subject 1; 7 Gz for 15 sec.

Subject 2; 5 Gz for 15 sec.

Subject 2; 6 Gz for 15 sec.

Subject 2; 7 Gz for 15 sec.

Subject 2; Simulated Air combat

Subject 3; 6 GZ for 15 sec.

Subject 3; 7 GZ for 15 sec.

Subject 4; 5 Gz for 15 sec.

Subject 4; 6 Gz for 15 sec.

Subject 4; 7 Gz for 15 sec.

Subject 4; Simulated Air Combat

INTEGRATED PROTECTIVE ENSEMBLE

CROSS-REFERENCE TO RELATED APPLICATIONS

This application claims priority under 35 U.S.C. §119(e) to U.S. Provisional Application Ser. No. 60/785,568 entitled "INTEGRATED AIRCREW ENSEMBLE," filed on Mar. 24, 2006, which is hereby incorporated herein by reference in its entirety for all purposes.

FEDERALLY SPONSORED RESEARCH

This invention was made with Government support under Contract No. #FA8650-04-C-6469 awarded by the U.S. Department of the Air Force. The Government has certain rights in this invention.

BACKGROUND OF THE INVENTION

1. Field of the Invention

At least one embodiment of the present invention relates generally to equipment for personal protection and comfort and, more particularly, to integrated protective ensembles.

2. Discussion of Related Art

Prolonged exposure to harmful and/or extreme environmental factors can lead to fatigue, discomfort, impaired performance and serious health problems. Technological advances in various lines of service and employment continue to widen the range of dangers associated with operational conditions, including climate, chemical, biological and ballistic threats. For example, pilots and aircrew, such as those of high-G performance aircraft, experience increasingly higher altitudes and rates of acceleration.

In response, attempts to evolve garment-based or otherwise wearable technology for personal comfort and protection from external conditions have typically involved adding-on capabilities to an original set of equipment. The result tends to be bulky and cumbersome, often leading to increased thermal burden and degradation in overall performance. Offering integration and flexibility in terms of functional design is a challenge.

BRIEF SUMMARY OF THE INVENTION

In accordance with one or more embodiments, the invention relates generally to an improved ensemble for personal protection and comfort.

In accordance with one or more embodiments, the invention relates to an integrated protective ensemble. The ensemble comprises a substantially waterproof liner having at least a torso portion, the liner comprising a closure system oriented substantially diagonally across the torso portion, constructed and arranged to facilitate dressing and removal. The ensemble further comprises a shell constructed and arranged to be worn in cooperation with the substantially waterproof liner, the shell having at least a torso portion. The shell comprises a storage system integrated on the torso portion, constructed and arranged to facilitate access to stored items, an integrated casing system constructed and arranged within the shell to provide conditioning for a body, and a shaping system constructed and arranged to conform the shell to the body.

In accordance with one or more embodiments, the invention relates to an integrated protective ensemble. The ensemble comprises a first multifunctional layer having at least a torso portion, the first layer comprising a closure system oriented substantially diagonally across the torso portion, constructed and arranged to facilitate dressing and removal. The first layer further comprises an integrated ventilation system, constructed and arranged to direct airflow substantially parallel to a body. The ensemble further comprises a second multifunctional layer constructed and arranged to cooperate with the first multifunctional layer.

In accordance with one or more embodiments, the invention relates to an integrated protective ensemble. The ensemble comprises a first multifunctional layer comprising an integrated ventilation system, constructed and arranged to direct airflow substantially parallel to a body. The ensemble further comprises a second multifunctional layer constructed and arranged to be worn in cooperation with the first layer, the second layer having at least a torso portion. The second multifunctional layer comprises an integrated casing system constructed and arranged within the second layer to provide conditioning and acceleration protection for the body.

In accordance with one or more embodiments, the invention relates to a multifunctional shell. The shell comprises a storage system integrated on a torso portion of the shell, constructed and arranged to facilitate access to stored items, an integrated casing system constructed and arranged within the shell to provide conditioning and acceleration protection for a body, and a shaping system constructed and arranged to conform the shell to the body.

Other advantages, novel features and objects of the invention will become apparent from the following detailed description of the invention when considered in conjunction with the accompanying drawings.

BRIEF DESCRIPTION OF THE DRAWINGS

The accompanying drawings are not intended to be drawn to scale. In the drawings, each identical or nearly identical component that is illustrated in various figures is represented by like numeral. For purposes of clarity, not every component may be labeled in every drawing. Preferred, non-limiting embodiments of the present invention will be described with reference to the accompanying drawings, in which.

DETAILED DESCRIPTION OF THE INVENTION

Figure 1:
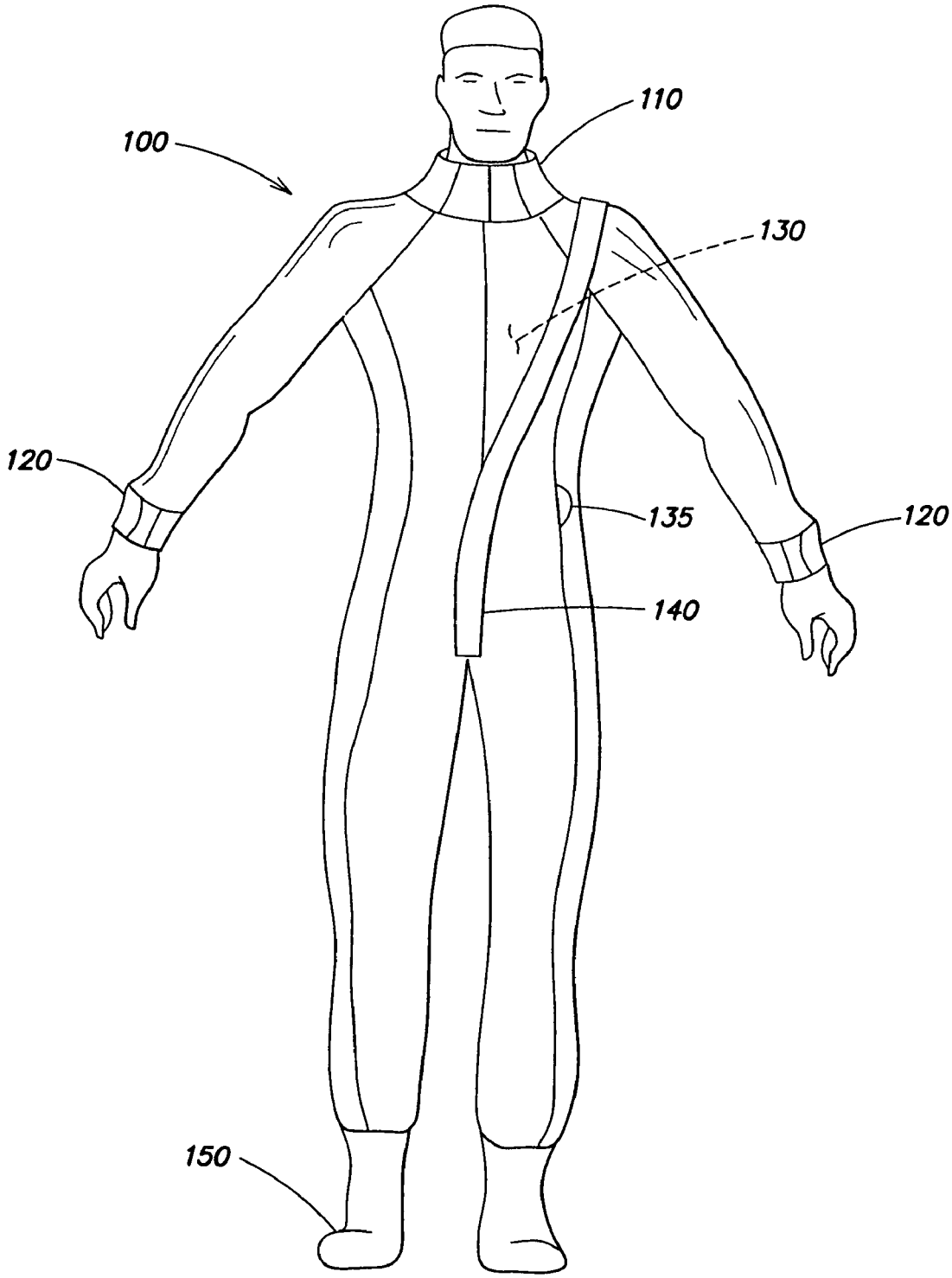
FIG. 1 illustrates a multifunctional layer of an integrated protective ensemble in accordance with one or more embodiments of the present invention.

This invention is not limited in its application to the details of construction and the arrangement of components as set forth in the following description or illustrated in the drawings. The invention is capable of embodiments and of being practiced or carried out in various ways beyond those exemplarily presented herein.

In accordance with one or more embodiments, the present invention relates generally to an integrated ensemble that provides a range of protection while significantly reducing bulk and heat stress levels typically associated with such equipment. Advanced materials technology, including multifunctional fabrics, is leveraged with unique design elements to create a functionally integrated protective ensemble. The resulting garment-based equipment may be generally effective in providing protection and personal comfort to a user of the ensemble.

Various types of potential users may be associated with distinct requirements for protection based on applicable environmental conditions. Such groups include, but are not limited to, fighter pilots, aircraft ground crew, firemen and other first responders, soldiers, athletes, race car drivers, "hazmat" operators, chemical plant operators, construction workers, and various medical personnel including surgical staff. For example, individuals may benefit from one or more types of protection including thermal, cold water immersion and/or acceleration (anti-G) protection. Equipment storage and/or carriage demands may also be pertinent. The ensembles presented herein are beneficially capable of customization to accommodate various requirements, as well as to target specific regions of a user's body for protection and comfort.

In accordance with one or more embodiments, the disclosed ensembles may be wearable systems. The systems are generally low bulk, designed to provide a requisite level of protection and enhance personal comfort while attempting to minimize the thickness and/or number of layers worn by a user in order to reduce thermal burden and facilitate mobility. The systems may also be flexible in terms of their functionality, generally adaptable in response to changes in a user's environment.

In at least one embodiment, a disclosed ensemble comprises garment-based equipment. For example, one or more elements of the disclosed systems may be incorporated into the form of a body suit, a vest, a jacket, shorts, trousers, or helmet. Body coverage may vary. In some embodiments, the ensemble may involve gloves, mask, hood and/or booties.

In accordance with one or more embodiments, the disclosed ensemble may generally involve an architecture of one or more multifunctional layers providing multiple protective capabilities. Each layer may include functionality directed to provision of specific types of protection and personal comfort. For example, each layer may include one or more functional elements as described in greater detail further below directed to thermal protection, weather protection, equipment storage, cold water immersion protection and/or acceleration (anti-G) protection. Material composition selected for any given layer may also be generally directed to personal protection and/or comfort as discussed herein. For example, one or more multifunctional layers may exhibit permeability, camouflage, reflective, wicking, waterproof, weatherproof, elastic, insulative, antimicrobial, non-melt and/or non-drip properties.

Placement and/or distribution of a particular functional element on and among layers may be dictated by factors including its intended purpose, advantageous distance from the body of a user, and/or region of the body to be targeted. Functional elements may be interchangeable among various multifunctional layers and any specific functionality is not limited to placement on a particular multifunctional layer discussed herein. Functionality of one layer may be partially or fully identical to the functionality of another layer. Alternatively, layers may have completely different functionality associated therewith. In some embodiments, cooperation between one or more layers, such as adjacent layers, may give rise to one or more types of protection. Layers may be independent of one another, designed to be worn by a user in a layered manner. Alternatively, two or more layers may be joined to each other, such as sewn, adhered, or coupled by a functional connection. In at least one embodiment, layers may be generally coextensive in terms of body coverage or, alternatively, layers may be applied to different regions of a user's body.

In some embodiments, one or more functional elements may be constructed and arranged to be removably connectable to various sources, such as a power or gas source, to enable its operation. For example, a ventilation system integrated in a multifunctional layer may be removably connectable to source of gas. A source may be a portable or tethered external supply, such as a blower, fan or compressed air canister. In other embodiments, the source may be an on-site supply. For example, the source may be installed at a construction site, athletic field, surgical theater, or be part of a vehicle air supply such as may be present in an airplane, race car or other mode of transport. Alternative, any required source may be fully integrated within the ensemble itself.

In at least one embodiment, the ensemble may generally comprise a system of two multifunctional layers. For example, a first multifunctional layer may be designed for wear proximate to the body of a user or over an undergarment. In some embodiments, the first multifunctional layer may be generally capable of providing immersion protection, ventilation, and/or cold weather protection. The first multifunctional layer may also have various chemical and/or biological protective properties. In at least one embodiment, the first multifunctional layer may serve as a liner. A second multifunctional layer may be designed for wear in cooperation with the first multifunctional layer, such as in a layered manner. In some embodiments, the second multifunctional layer may be capable of providing protection against flame, acceleration, and other environmental factors, providing ventilation and/or providing gear carriage capabilities. In at least one embodiment, the second multifunctional layer may serve as a shell.

Either multifunctional layer may have different and/or additional functionality from that exemplarily discussed herein. In operation, a user may choose to wear one or both layers depending on requirements dictated by environmental conditions. For example, in applications where the functionality of a first multifunctional layer is not required, such as when cold water immersion is not a concern, a second multifunctional layer may be worn proximate to the body of the user without the first layer. Additional layers may be present in the ensemble as well. The ensembles disclosed herein may be used in conjunction with other equipment, such as that intended for protection, comfort, storage and/or carriage, including other garment-based devices.

In accordance with one or more embodiments, a first multifunctional layer, for instance a liner 100, may generally include one or more functional elements such as those exemplarily illustrated in FIG. 1. During use, liner 100 may be in direct contact with the user's body, or may alternatively be applied over an undergarment. Liner 100 may be constructed and arranged to provide any desired degree of body coverage. For example, in at least one embodiment, liner 100 may substantially cover a user's body, including torso, arms and legs. Integrated functionality of liner 100 may be directed to one or more requirements as needed. For example, liner 100 may be generally aimed at personal cooling, cold water immersion protection, as well as cold weather protection, as illustrated in FIG. 1.

A multifunctional layer, such as liner 100, may be constructed of any material capable of promoting personal comfort aims and/or fulfilling various predetermined protection requirements, such as those dictated by expected and/or potential environmental conditions. For example, in applications wherein breathability of liner 100 is desirable, liner 100 may be a substantially gas permeable layer. As used herein, "permeable" generally refers to having pores or openings that permit liquids or gases to pass through. In at least one embodiment, a user may advantageously discern gas flow through permeable liner 100, such as when a cooling system is integrated therein. Liner 100 may be a relatively thin layer and/or be streamlined to generally contour a user's body in order to reduce bulk and/or heat stress.

In accordance with one or more embodiments, a multifunctional layer, such as liner 100, may be made of a natural or synthetic material but should generally be compatible with intended use for the disclosed integrated ensemble. For example, in applications involving high temperatures or threat of fire, flame resistance may be important and a substantially non-melt and/or non-drip material may be selected for liner 100. Thus, it may be desirable to select a natural fiber or avoid certain synthetic materials that may exacerbate burn wounds. As used herein, "non-melt" refers generally to having a sufficiently high melting point such that the material will not substantially change phases under anticipated environmental conditions. For example, liner 100 material may be required to withstand environmental temperatures of up to 125 degrees Fahrenheit or higher for a given application. As used herein, "non-drip" refers generally to physical properties such that molten materials will tend not to form and/or fall in drops. Various tests and/or standards for material properties commonly known to those skilled in the art, such as the Thermal Stability Test, Vertical Flammability Test (ASTM D-6413), and NFPA 1951: Standard on Protective Ensemble for USAR Operations may be referenced in selecting material for various multifunctional layers of the disclosed integrated protective ensembles.

In some embodiments, a multifunctional layer may exhibit wicking properties for enhanced cooling and comfort. As used herein, "wicking" refers generally to an ability to promote absorption of moisture, such as perspiration off the skin or an undergarment. In some embodiments, the wicking material may be a natural fiber such as wool. Without wishing to be bound by any particular theory, liner 100, for example, may enhance the rate and uniformity of evaporative cooling by diffusing moisture through wicking.

According to one or more embodiments of the present invention, the material of a multifunctional layer may be a substantially elastic material. As used herein, the term "elastic" refers generally to an ability to repeatedly deform or stretch from, and subsequently return to, a normal condition, position or shape such as when dictated by a user's motion. An elastic material may beneficially promote mobility and comfort for a user, and may facilitate bulk reduction. In at least one embodiment, liner 100, for example, may be constructed of a two- or four-way stretch material.

A multifunctional layer, such as liner 100, may also exhibit insulative properties when desirable. As used herein, the term "insulative" refers generally to an ability to prevent passage of heat or cold. Certain potential applications for the disclosed ensemble, wherein a user may be exposed to uncomfortably low temperatures, such as ambient temperatures of below 60 degrees Fahrenheit, may require or benefit from an insulating liner 100. Pilots and aircrew, for example, may experience low air temperatures depending on flight altitude. Low environmental temperatures may also be associated with cold water immersion. In at least one embodiment, liner 100 may therefore be able to prevent declines in body temperature of, for example, more than two degrees Fahrenheit over the course of an hour in 32 degrees Fahrenheit water.

In accordance with one or more embodiments, a multifunctional layer may generally be a weatherproof layer. For example, liner 100 may be a substantially waterproof garment layer. The term "waterproof" as used herein refers generally to liquid barrier properties of a material. Liner 100 may provide varying levels of waterproof protection depending on specific requirements for an intended application. For example, liner 100 may be characterized as providing full waterproof protection when exhibiting an ability to support a 30-inch hydrostatic head for three minutes without allowing passage of a predetermined amount of liquid based on results generated by a standard hydrohead test device. Waterproof protection may be provided by implementing one or more suitable techniques commonly known in the art. For example, the material of liner 100 may be coated or laminated with a substantially waterproof membrane such as PTFE, polyester, polyurethane, polyethylene or other commercially available stretch membrane in accordance with one or more embodiments of the present invention. An ability to reject other fluids, including aerosols and vapors, may be an additional consideration in selecting a material for liner 100. In at least one embodiment, a coating, such as a PTFE plasma coating, may be applied to fibers of a multifunctional layer to impart substantially hydrophobic properties to the layer. Seam sealing among components of a multifunctional layer may also promote waterproofing through employing methods such as taping, gluing, ultrasonic welding and/or heat sealing.

In at least one embodiment, a multifunctional layer, such as liner 100, may include neck seals 110 and/or wrist seals 120 for providing waterproof protection. The neck seals 110 and/or wrist seals 120 may be permanently sealed to liner 100 around neck and wrist regions, respectively, and configured to generate a substantially tight, waterproof fit with respect to a user's body. For example, seals 110, 120 may comprise a material with waterproof qualities, such as latex or neoprene. Alternatively, seals 110, 120 may be constructed and arranged to be self-closing, remaining open until closure is needed, such as when a user enters a submerged state. Automatic seal closure may be implemented with any suitable means known in the art. For example, water-activated systems involving integrated superporous hydrogels offering rapid swelling, rubber elasticity and hydrostatic pressure resistance may be integrated. Such self-closing neck seals 110 and wrist seals 120 may be reversibly sealable and may also be removable for laundering.

In accordance with one or more embodiments, a multifunctional layer may include an integrated conditioning system, such as ventilation system 130. In at least one embodiment, ventilation system 130 may be implemented using a body ventilation system and method as described in copending U.S. patent application Ser. No. 11/584,340 to Isherwood et al. which is hereby incorporated herein by reference in its entirety. The ventilation system 130 is generally a body conformable design capable of delivering gas substantially parallel to a user's body via a network of gas flow elements. In at least one embodiment, a multifunctional layer, such as liner 100 may comprise a permeable substrate for a gas distributor of ventilation system 130. In applications in which a user may experience elevated levels of thermal burden, ventilation system 130 may generally be capable of providing the user with a perceived cooling effect for enhanced comfort. Ventilation system 130 is typically low profile, flexible and capable of withstanding compression such as that due to gear carriage. Ventilation system 130 may service one or more regions of a multifunctional layer, such as the front torso, back torso, legs and/or arms. A gas port 135 may be fluidly connected to ventilation system 130 to supply gas for operation. One or more gas release valves may be needed to facilitate functioning of ventilation system 130 in conjunction with waterproofing features of liner 100, for example, as dictated by the nature of any neck and/or wrist seals 110, 120.

A multifunctional layer may also include a closure system. For example and as illustrated, one or more embodiments of liner 100 typically includes a closure system 140. Closure system 140 may involve one or more features for assisting a user in dressing and removal of liner 100 as desired. Design considerations for closure system 140 may include, for example, comfort, ease of use, and minimizing interference with other elements of the disclosed ensemble. Closure system 140 may generally be constructed and arranged to secure a user within liner 100, such as with zippers, snaps, hook and loop closures, or other known closure mechanisms. Closure system 140 may be substantially waterproof in cooperation with other waterproofing features of liner 100. For example, the slide fastener may generally involve a fastener on a waterproof tape and include a cover flap. In at least one embodiment, closure mechanism 140 includes a single fastener, such as an opposing slide fastener commercially available from Riri, Inc., to facilitate both entry and bladder relief by a user. As illustrated in FIG. 1, for example, closure system 140 may have a generally diagonal orientation along a front torso region of liner 100. More specifically, closure system 140 may operate from a shoulder to a lower mid-torso region of liner 100, such as in a generally S-shaped course. In donning liner 100, a user may step into both leg portions of liner 100, push his/her head through neck seal 110 while inserting a first arm through an associated first wrist seal 120, and then insert a second arm though a second wrist seal 120 before engaging closure system 140. Bladder relief devices may be integrated in liner 100 to facilitate employment by both male and female users.

In accordance with one or more embodiments, protection for various extremities may be integrated into a multifunctional layer. For example, booties 150, gloves (not shown) and/or a hood (not shown) may be incorporated into liner 100. These may be permanently or semi-permanently attached to liner 100, and may exhibit additional protective qualities, such as thermal protection through integration of warming elements. In at least one embodiment, a flotation assistance device, such as a flotation collar, may be integrated. A multifunctional layer may also include integrated resistive heating. A multifunctional layer may involve personal protection and/or comfort features other than those exemplarily discussed herein.

Figure 2:
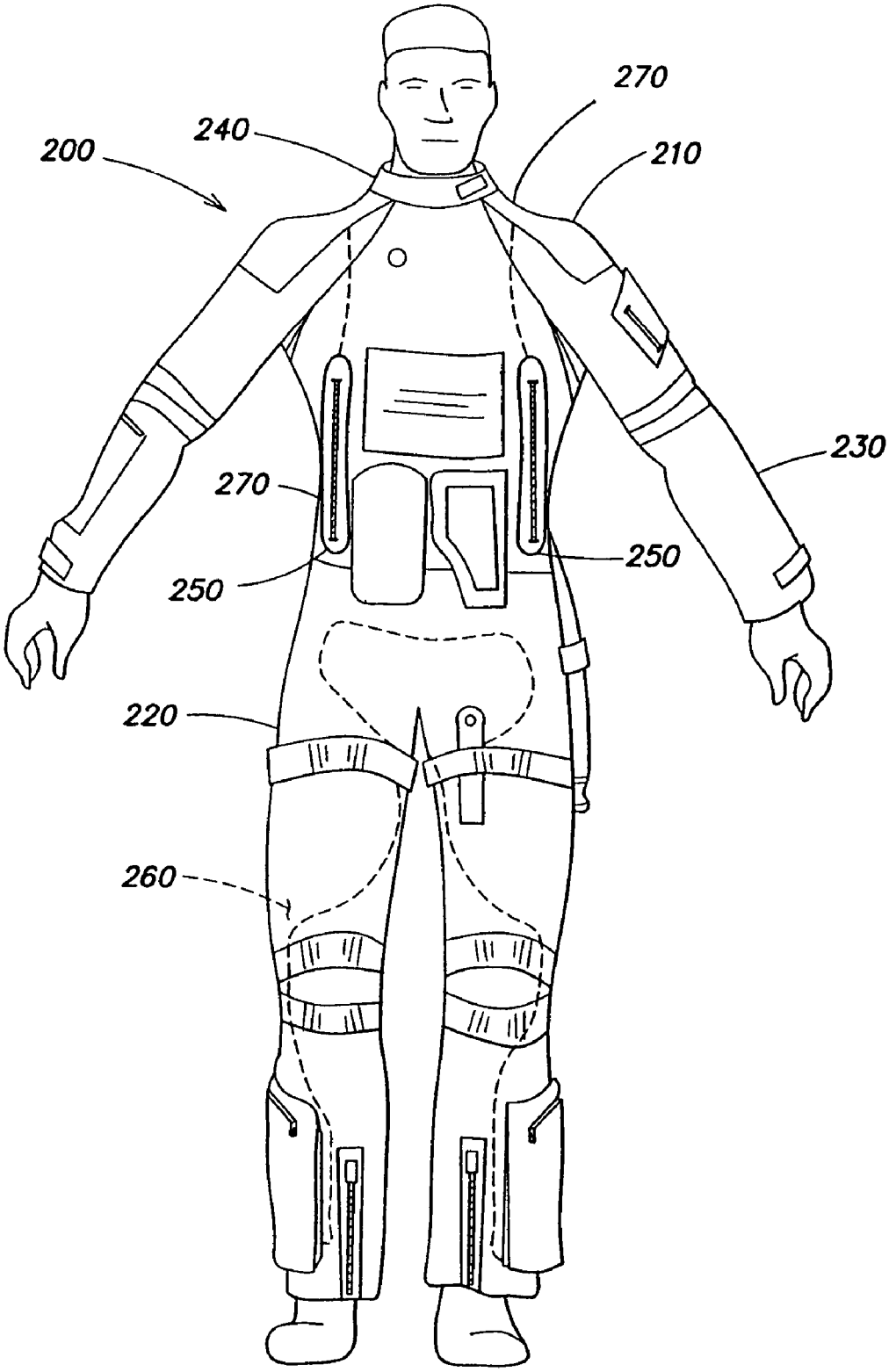
FIG. 2 illustrates a multifunctional layer of an integrated protective ensemble in accordance with one or more embodiments of the present invention.

In accordance with one or more embodiments of the present invention, the disclosed ensemble may include a second multifunctional layer, for instance a shell 200, generally including one or more functional elements such as those illustrated in FIG. 2 for purposes of example only. The second multifunctional layer may generally cooperate with another multifunctional layer, such as the first multifunctional layer. For example, shell 200 may be worn over liner 100 or another undergarment. Alternatively, shell 200 may be worn proximate to the skin as discussed above.

A multifunctional layer, shell 200 for example, may be substantially low-bulk while providing sufficient fitting room to accommodate an underlayer, such as liner 100. Shell 200 may generally be constructed of a flexible material for comfort and mobility. As with liner 100, various potential environmental factors may impact choice of material. For example, in some applications it may be desirable for shell 200 to be substantially flame resistant, such as non-melt and/or non-drip. In at least one embodiment, shell 200 may be constructed of a material containing NOMEX® fiber commercially available from DuPont. For example, shell 200 may contain about 97% NOMEX® fiber and about 3% of an anti-static additive. The second multifunctional layer may also exhibit weatherproof (such as hydrophic or waterproof), wicking, insulative, permeability, antimicrobial and/or other material properties as desired.

In at least one embodiment, a multifunctional layer, such as shell 200, may generally include one or more design features to enhance comfort and/or mobility. For example, shell 200 may include one or more articulated joints 210, such as at elbow and shoulder regions, to facilitate range of motion. Shell 200 may also integrate stretch panels 220, such as at the shoulder and/or lower back regions to augment movement and the ability to sit comfortably, particularly when shell 200 is tightened for use. Extra space at underarm regions may be provided as well, such as through incorporation of raglan sleeves 230 for comfort. Additional features may likewise be integrated into the design of shell 200 for safety. For example, a substantially raised collar 240, such as a mandarin collar, may be incorporated for in-place neck protection of a user. Shell 200 may also include reinforcement in various high-wear areas, such as knees and elbows.

Figure 3:
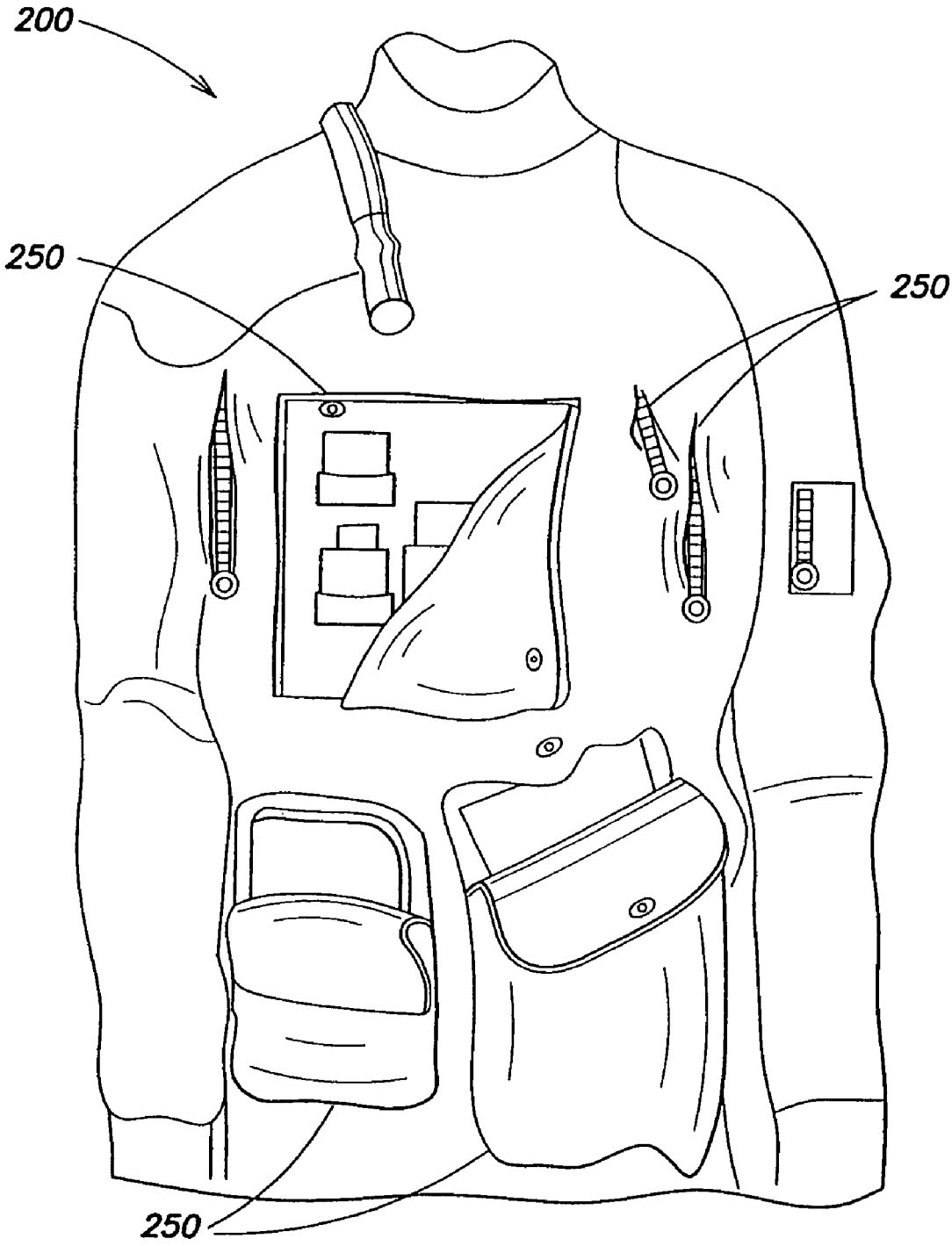
FIG. 3 illustrates a storage system for a multifunctional layer of an integrated protective ensemble in accordance with one or more embodiments of the present invention.

In accordance with one or more embodiments, a multifunctional layer, such as shell 200, may include an integrated storage system. The storage system may generally facilitate access to stored items. Carriage by a user may be facilitated by one or more integrated storage features 250. Placement, number and/or nature of storage features 250 on shell 200 may be provided in any desired manner, such as to make useful items available within easy reach of a user. For example, one or more storage features 250 may be integrated on a front torso region of shell 200. Storage features 250 may generally involve any mechanism capable of facilitating carriage of one or more items. The types of items to be stored, such as survival gear or safety equipment, may be specified by applicable requirements. The size and/or nature of a particular item to be carried may dictate characteristics of a storage feature 250. In at least one embodiment, storage features 250 may include inner and/or outer pockets, as well as other mechanisms such as loops, hooks and clips configured to hold items. In embodiments where storage features 250 include pocket bags, these may be constructed from a mesh material so as to minimize thermal burden. Interior pockets, and a reduced number of external pockets, may create a more streamlined load and reduce the possibility of losing items. One example of a potential arrangement of storage features 250 on shell 200 is illustrated in FIG. 3.

In at least one embodiment, storage features 250 may be based on pull-out platform designs where items are held in place on a platform via an elastic or other suitable material. The platforms may be tethered, and constructed and arranged to be pulled out for ease and organized access by a user. In at least one embodiment, the platforms may be removable. Finger loops on movable platforms may also be integrated to enable one-handed access to items that may otherwise be out of reach. Such platforms may be constructed using a spacer fabric to reduce thermal burden of the platform layer, provide structural stability for supporting items, and provide cushioning between stored gear and a body of the user.

Figure 4:
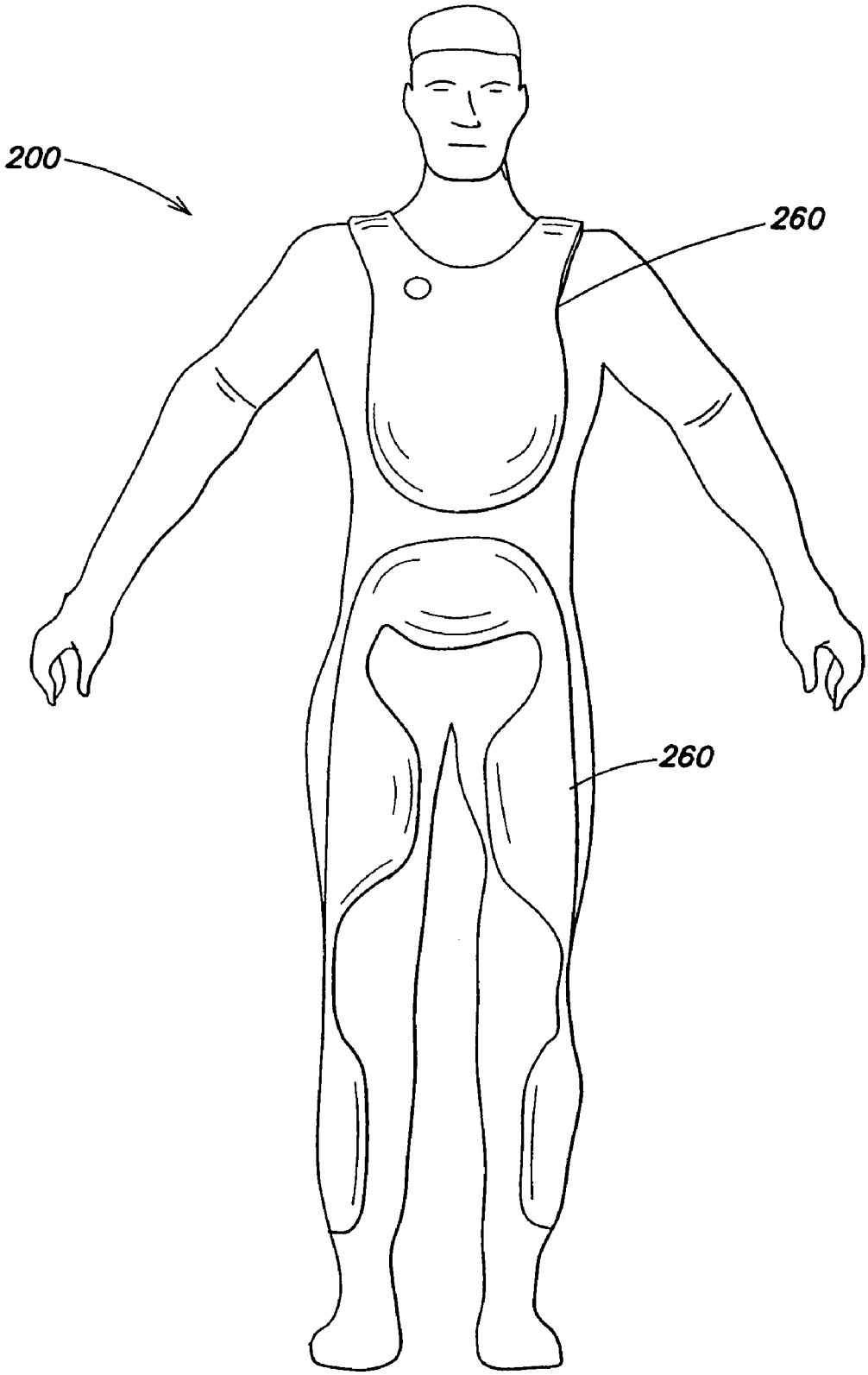
FIG. 4 illustrates placement of one or more integrated casing systems on a multifunctional layer of an integrated protective ensemble in accordance with one or more embodiments of the present invention.

In accordance with one or more embodiments, a multifunctional layer, such as shell 200, may also include one or more integrated casing systems 260. Casing system 260 may generally be capable of providing conditioning, such as ventilation or cooling, to a user. Casing system 260 may also provide acceleration protection as discussed herein. Casing systems 260 may be integrated into a multifunctional layer, such as shell 200, in any desired position. For example, the construction of the present invention may provide cooling specifically to areas prone to heat build-up. Casing systems 260 may be shaped and oriented to target particular regions of a user's body as well. FIG. 4 illustrates a potential arrangement of two casing systems 260, a first positioned to correspond with thigh, calf and abdomen regions of a user, and a second positioned to correspond with a user's chest region. Casing system 260 should generally be constructed of a high-strength material, and may be substantially non-melt and/or non-drip as may be required.

Figure 5A:
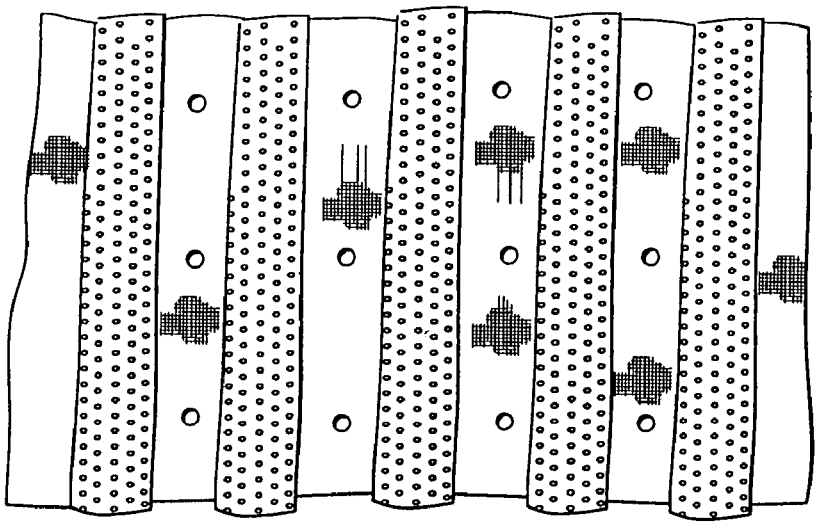
FIGS. 5A and 5B illustrate flat ribbing and piped ribbing patterns, respectively, of a casing system sheath in accordance with one or more embodiments of the present invention.
Figure 5B:
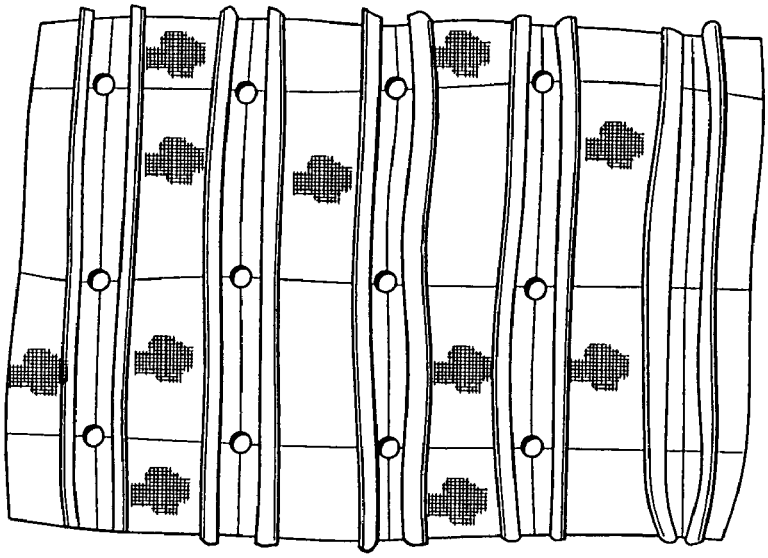

In accordance with one or more embodiments, gas may be provided to casing system 260, such as by a duct and/or manifold, for ventilation. For example, casing system 260 may comprise a sheath, generally defining an interior space of casing system 260, for collection and distribution of gas. The sheath may be constructed of a perforated material, allowing gas to flow through casing system 260. In some embodiments, the gas may flow generally towards or in the direction of the body of a user. In some embodiments, a surface structure of the sheath of casing system 260 may form channels, for example, by defining flat or piped ribbing patterns as illustrated in FIGS. 5A and 5B, respectively, to facilitate gas flow for ventilation. For example, the sheath of casing system 260 may generally create air pockets to promote air flow, such as between layers of the disclosed ensemble or between a multifunctional layer and a user's body. Some materials for the sheath of integrated casing system 260, such as muslin or silk, may also enhance wicking to further condition the body as discussed above. Additionally or alternatively, ventilation functionality may be integrated into shell 200 implementing structures similar to ventilation system 130 discussed above, and vice versa.

Figure 6:
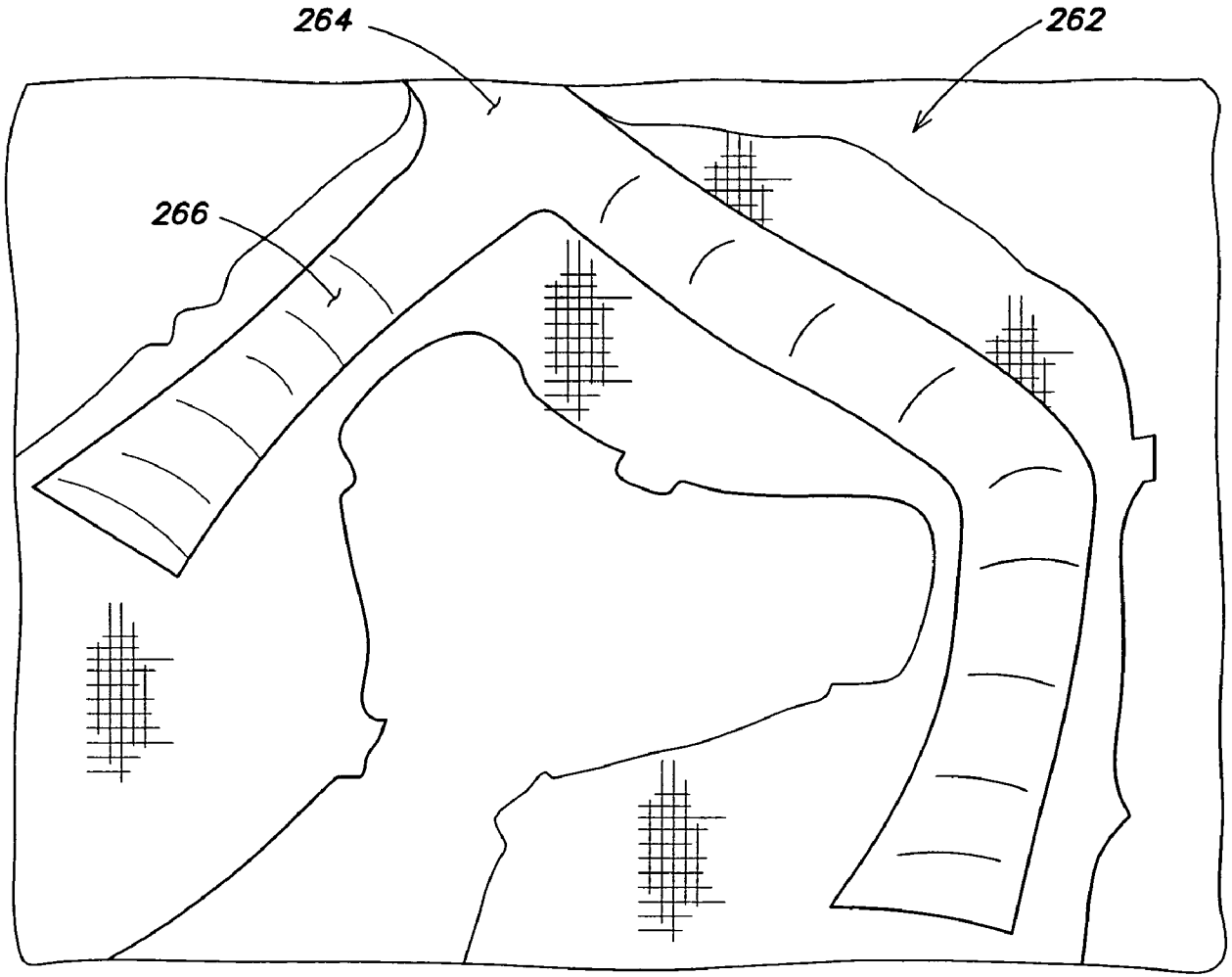
FIG. 6 details a bladder for a multifunctional layer of an integrated protective ensemble in accordance with one or more embodiments of the present invention.

In at least one embodiment, one or more counter-pressure bladders 262 may be positioned within casing system 260. Bladder 262 may be surrounded by the sheath of casing system 260. FIG. 6 details a bladder 262 in accordance with one or more embodiments of the present invention. For example, gas may be supplied to bladder 262 by a duct via manifold 264. Bladder 262 may therefore be filled or inflated to provide acceleration (anti-G) protection to a user by exhibiting counter-pressure. As discussed above, gas may also be supplied to a space around bladder 262, such as may be defined by the sheath of casing system 260, for ventilation. Thermal improvements may be made by using a breathable material for bladder 262 construction, such as ULTREX® supplex nylon. In the absence of forced air flow, breathable bladders 262 may allow for better passive cooling by increased permeability of bladder 262 material covering the body. Bladder supports 266 may be integrated into bladder 262 to generally prevent collapse of interior space to be filled with gas, such as may be due to compression while seated or other applied force. A spacer fabric may be incorporated within bladder 262 to maintain an open space within bladder 262 even under no active air flow.

The ducts and/or manifolds to supply gas to casing system 260 for ventilation and/or acceleration protection should generally be high strength, durable, flexible and substantially incompressible to avoid pinch points. Both should also be substantially air impermeable and sealable to avoid leaks. In some embodiments, a coated fabric such as a coated nylon or cotton may be used for a gas duct and manifold. A membrane laminated fabric material may also be used. In operation, gas may travel from one or more gas sources (not shown) along a gas duct to enter a manifold, such as manifold 264. In some embodiments, the gas source may be directly connected to a manifold. The gas may then be distributed to the interior of casing system 260 for ventilation as well as to bladders 262 for acceleration protection. The gas sources may include a gas supply and associated equipment such as fans, blowers, pumps and vacuums generally required to generate and maintain gas flow. As discussed above, a gas source may be portable, tethered, integrated, or may be available on-site, such as for plug-in access.

The flow rate and system pressure within casing system 260 should generally be sufficient to provide discernible gas flow and adequate to achieve enhanced personal comfort. Gas supplied to bladders 262 should be sufficient to exhibit effective counter-pressure. In some embodiments, one or more internal ducts may facilitate establishing uniform airflow to distant regions within casing system 260. A spacer fabric in the internal duct may be implemented to prevent blockage of airflow in case of restriction, for example by a harness or while seated, even under no active air flow.

The gas from the gas sources to be delivered for ventilation may be treated or conditioned for enhanced personal comfort. The gas may therefore be conditioned to facilitate heating, cooling, humidification, dehumidification, or circulation of filtered or otherwise treated gas. It is therefore contemplated that embodiments of the present invention may be used to treat conditions such as hypothermia and hyperthermia, as well as to facilitate therapeutic treatments. In some embodiments, casing system 260 may also be configured to exhaust or extract gas, such as through reverse flow to the gas source by a vacuum pump. For example, it may be configured to extract gas such that gas flows through casing system 260 and exits a manifold.

The number, construction and/or arrangement of casing systems 260 integrated in a multifunctional layer, such as shell 200, can vary dramatically depending on an intended application. In at least one embodiment, a ventilation and/or anti-G protection requirement for a class of users may first be determined. Casing systems 260 may then be selectively disposed based on the determined requirement to target regions of a user's body. For example, various embodiments of the present invention may target a user's torso, arms, legs, pelvis and/or head. In one embodiment, shell 200 may have multiple casing systems 260 stemming from a single manifold. Another embodiment may have a manifold and a casing system 260 stemming from a gas duct roughly every few inches.

Multiple casing systems 260 may be connected as part of a larger system. The multiple systems may be arranged in series or parallel from a single or multiple source of gas. For example, a first system targeting a wearer's chest or torso may be fluidly connected to a second system targeting a wearer's leg. In other embodiments, a single source of gas may provide gas flow to multiple users. In at least one embodiment, ventilation systems on two or more multifunctional layers may cooperate. For example, a single source of gas may supply ventilation systems on two or more multifunctional layers, such as liner 100 and shell 200. Various integrated ventilation systems may also share gas ducts and/or manifolds.

In accordance with one or more embodiments, a multifunctional layer, such as shell 200 may also include a closure system 270. Closure system 270 may employ any commonly known closure mechanisms such as those described above with respect to closure system 140. Integration of functionality in a multifunctional layer, such as storage features 250 and casing system 260 discussed above, may be accommodated by the configuration of closure system 270. For example, closure system 270 may generally be constructed and arranged to provide a free area on the front torso region for integration of storage features 250 as well as counter-pressure bladders in a chest region casing 260 as desired.

In at least one embodiment, closure system 270 may generally facilitate side entry by a user. For example, closure system 270 may include a first closure mechanism operating along a side torso region of shell 200, such as from a user's elbow to knee. Closure system 270 may also include a second closure mechanism operating at a neck region of shell 200, such as from a user's neck to shoulder, providing the user with additional space to facilitate entry into and out of shell 200. In donning shell 200, a user may step into both leg portions of shell 200, push his/her head through raised collar 240 while inserting a first arm through an associated first arm portion, and then insert a second arm though a second arm portion before engaging closure system 270. Finger loops (not shown) at the end of arm portions may facilitate closure with an intuitive grab feature to provide resistance while closing shell 200 via closure system 270.

In accordance with one or more embodiments, a shaping system may be integrated in shell 200 or other multifunctional layer to facilitate adjustment of the integrated ensemble relative to the body contour of a specific user. Proper adjustment and/or fitting may be important for comfort, motion, and to ensure anti-G protection capabilities. The shaping system may generally involve one or more shaping mechanisms placed on regions of a multifunctional layer that may require custom fitting. Segmentation of the shaping system, such as through strategic placement of multiple shaping mechanisms, may enable further customization and accuracy of fit along a length of a user's body. Shaping mechanisms may be positioned, for example, on a front torso, back torso, arm and/or leg region of shell 200 as desired. Any commonly known shaping technique may be implemented in shaping mechanisms. For example, in some embodiments, a shaping mechanism may involve lacings, belts or another tensioning, tightening or fitting device.

Figure 7B:
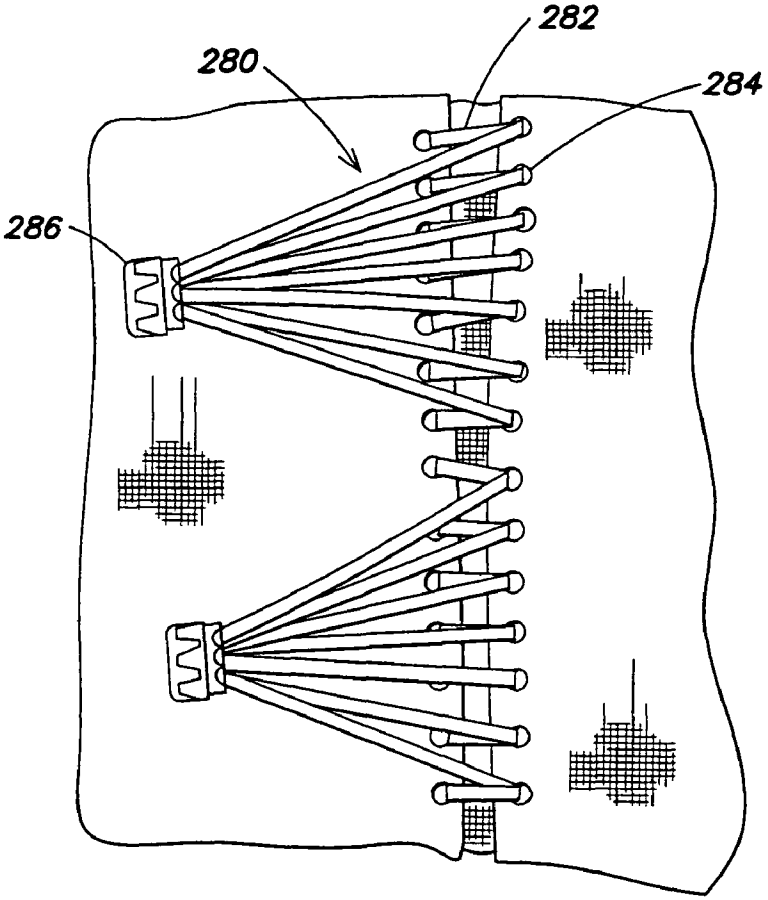
FIGS. 7A and 7B illustrate a shaping system for a multifunctional layer of an integrated protective ensemble in both open and closed orientations, respectively, in accordance with one or more embodiments of the present invention.
Figure 7A:
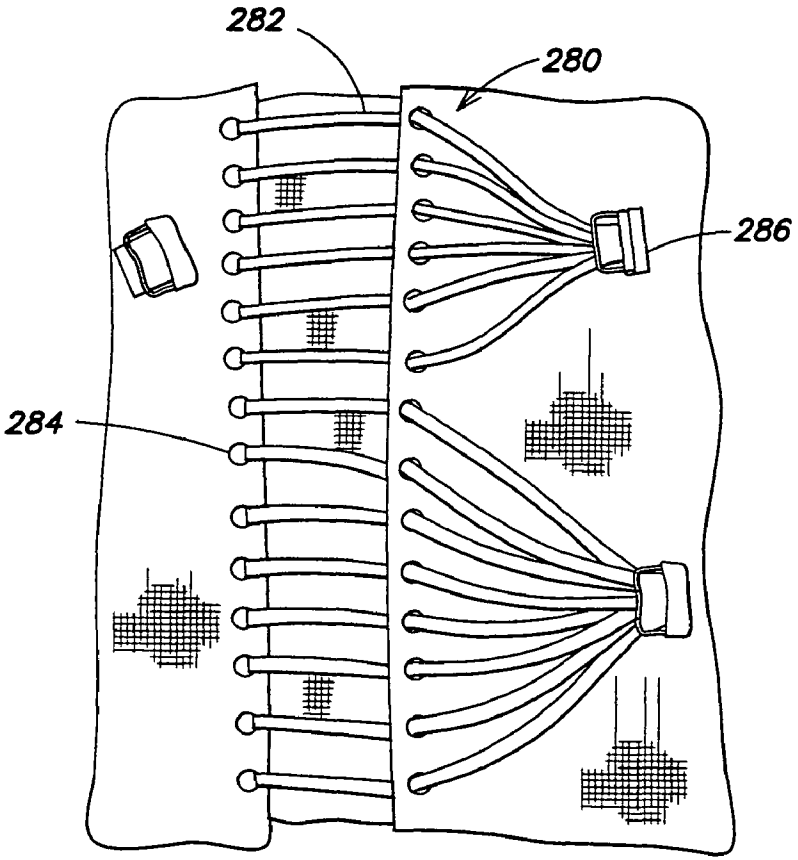

In one preferred embodiment, one or more shaping mechanisms 280 comprises a mechanism constructed and arranged to facilitate ease of adjustment, such as with a single motion. For example, a shaping mechanism 280 may involve a fan lacing arrangement as illustrated in FIGS. 7A and 7B. Lacing elements 282 may be attached to one or more regions of shell 200, such as by threading them through an array of eyelets 284 positioned on one or more regions of shell 200. Free ends of a plurality of lacing elements 282 may be fed through a single holding device, such as buckle 286, in an open orientation as illustrated in FIG. 7A. In a closed orientation as illustrated in FIG. 7B, the plurality of free ends of lacing elements 282 may be simultaneously pulled through buckle 286 to increase tension therein. Eyelets 284 associated with a single lacing element 282 may therefore be pulled closer together and/or closer to buckle 286, generally narrowing gaps in shell 200 to result in an increasingly contoured fit relative to a user's body. Multiple lacing elements 282 may be tightened simultaneously such that a shaping mechanism 280 may be actuated with a single motion.

A multifunctional layer, such as shell 200, may also include an integrated or partially integrated harness (not shown). For example, a rear of a harness may be integrated into a rear torso portion of shell 200. A front of the harness may be exposed and configured in a substantially modular manner to accommodate attachment of various harness structures, such as those associated with aircraft. The harness may be padded and include leg loops which may be contoured and/or removable.

One or more sensors may be integrated in a multifunctional layer to monitor characteristics of a user and/or operational parameter of the integrated protective ensembles disclosed herein. Such sensors may include, for example, temperature sensors, pressure sensors and flow meters. One or more functional elements may be controlled based on information collected by the sensors via a control system. Communication equipment, such as GPS technology, radios and alarms may also be integrated. In some embodiments, audible and/or visual cues may be generated, such as to signal distress, based on information collected by one or more sensors.

Existing garments or protective equipment may be retrofitted in accordance with one or more embodiments of the present invention.

The function and advantages of these and other embodiments of the invention can be further understood from the examples below, which illustrate the benefits and/or advantages of the system and methods of the invention but do not exemplify the full scope of the invention.

EXAMPLE 1

Quantitative Performance of an Integrated Protective Ensemble Including Counter-Pressure Bladder Testing was conducted by General Dynamics Corporation at the Wright-Patterson Air Force Base (WPAFB) Dynamic Environment Simulator (DES) centrifuge. Four trained subjects were each exposed to five different acceleration scenarios: gradual onset to 7 Gz (0.1 Gz/sec), 5 Gz for 15 sec, 6 Gz for 15 sec, 7 Gz for 15 sec, and simulated air combat including multiple peaks. Integrated counter-pressure bladders were tested to determine whether they were capable of withstanding specific applied pressures, for example, without popping.

A bladder, such as that illustrated in FIG. 6, made of waterproof/breathable ULTREX supplex nylon was installed into each of two prototype casing systems in accordance with one or more embodiments of the present invention. The first prototype casing system was made of silk and included piped ribbing for enhanced ventilation. The second prototype casing system was made of silk with flat ribs for enhanced ventilation. Each casing system was installed in a multifunctional layer in accordance with one or more embodiments of the present invention.

Figure 8A:
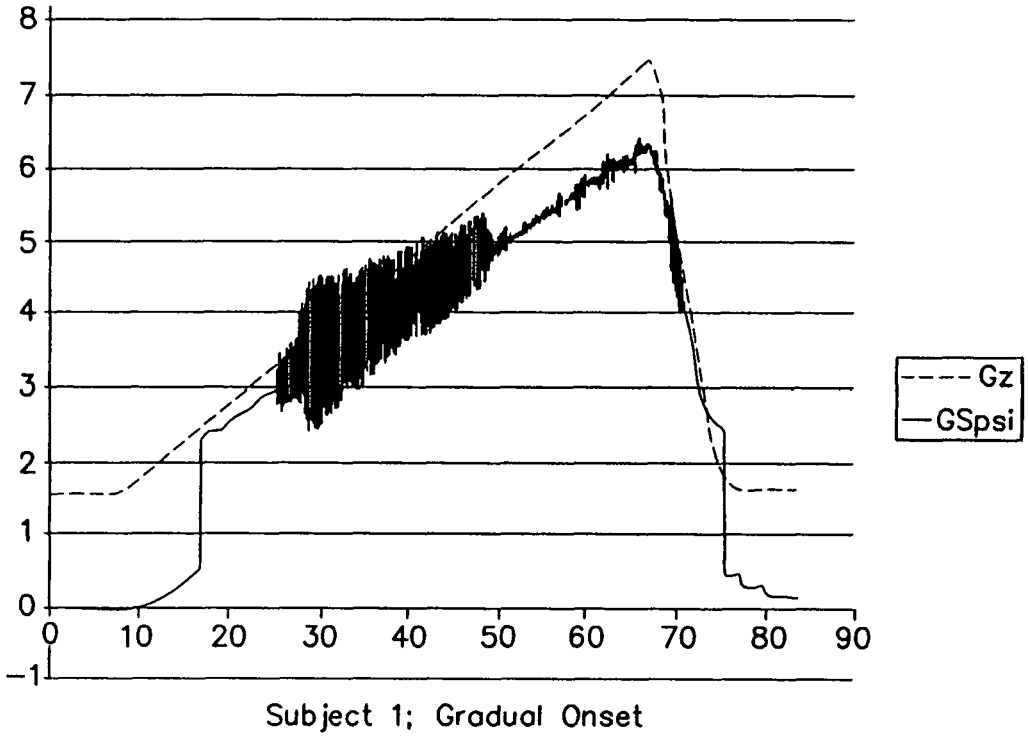
FIGS. 8A through 8T present data collected during quantitative analysis of an integrated protective ensemble in accordance with one or more embodiments of the present invention tested under various acceleration scenarios.
Figure 8B:
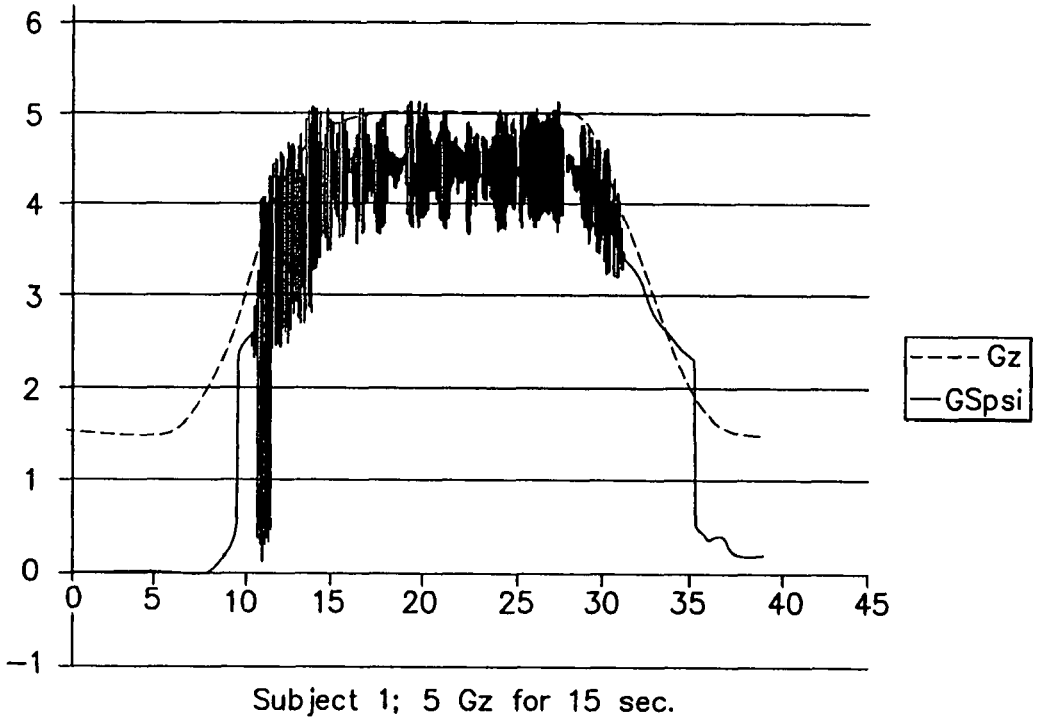
Figure 8C:
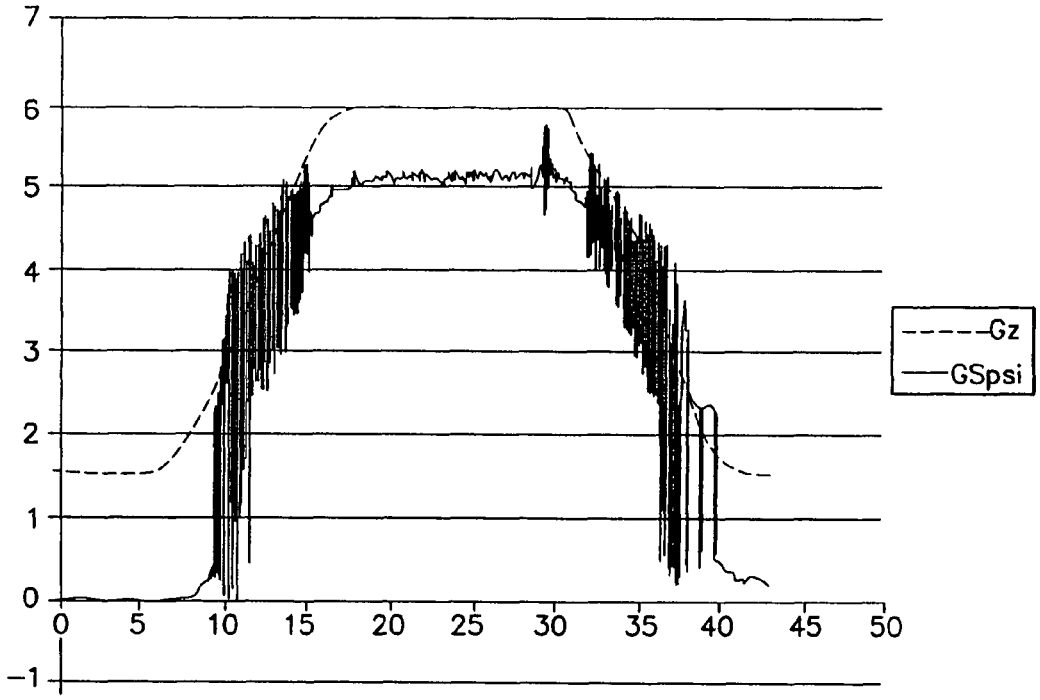
Figure 8D:
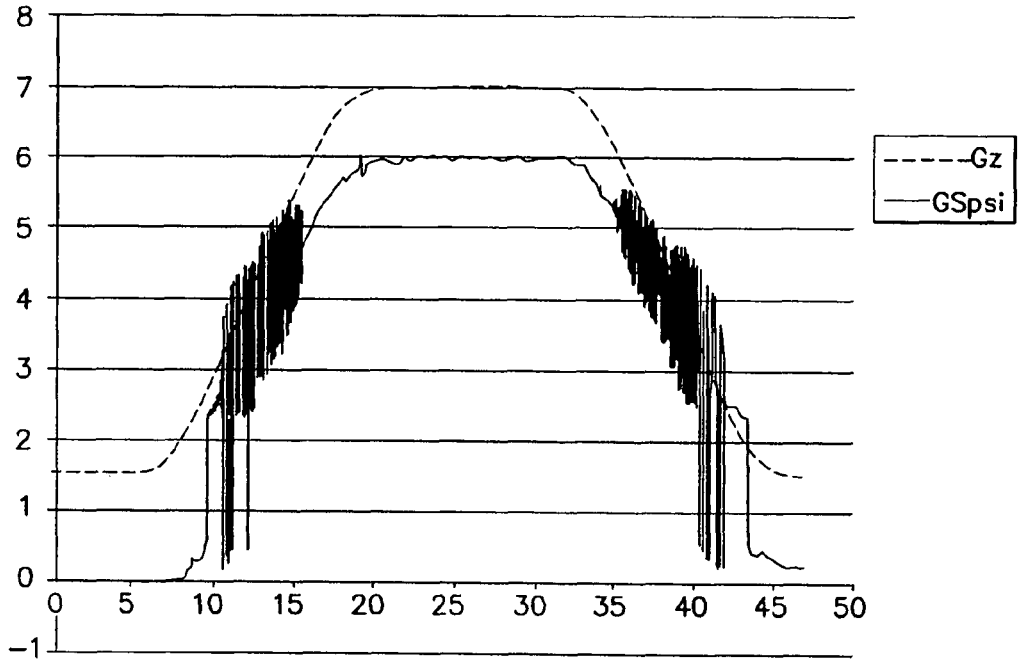
Figure 8E:
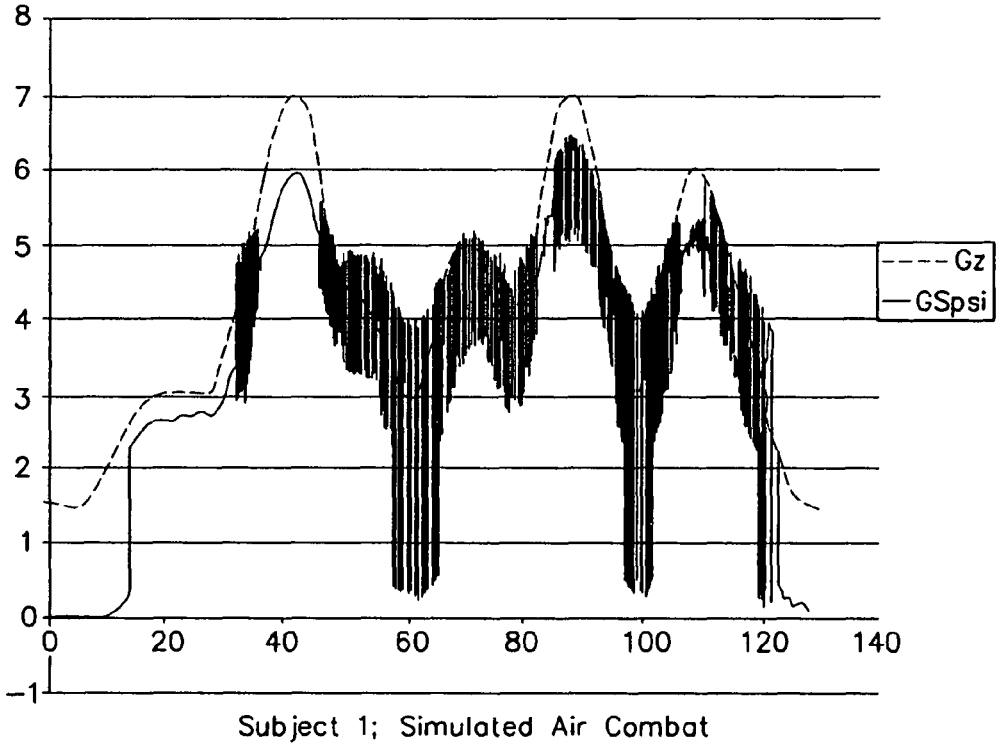
Figure 8F:
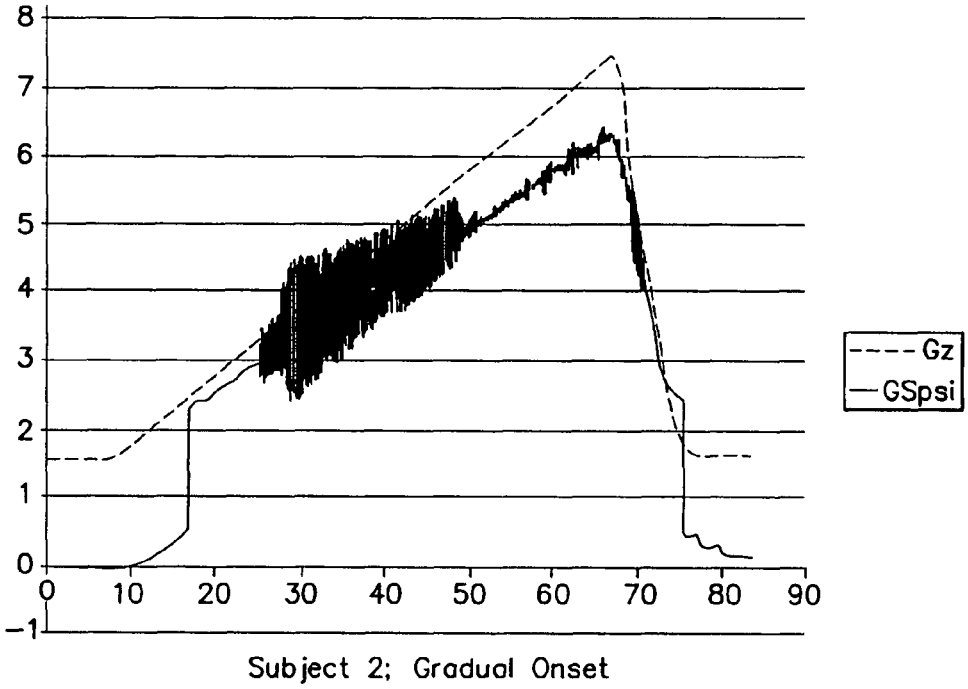
Figure 8G:
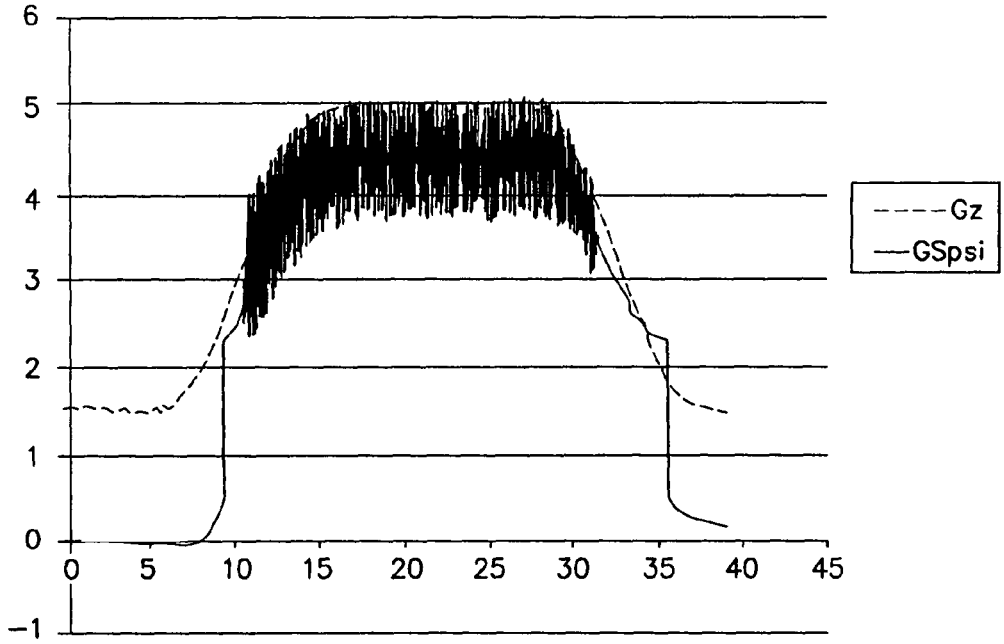
Figure 8H:
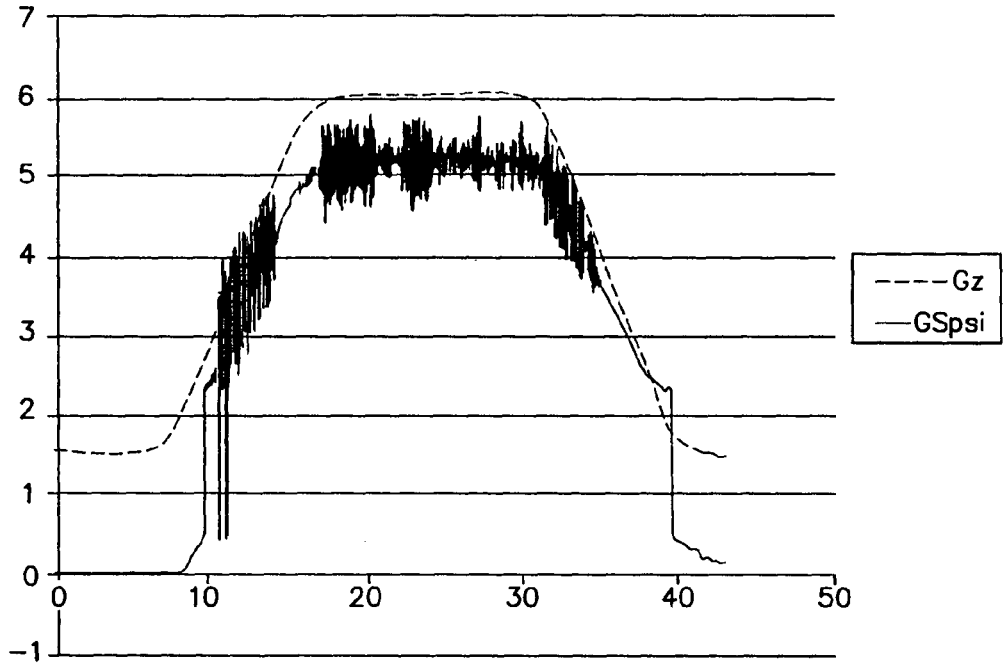
Figure 8I:
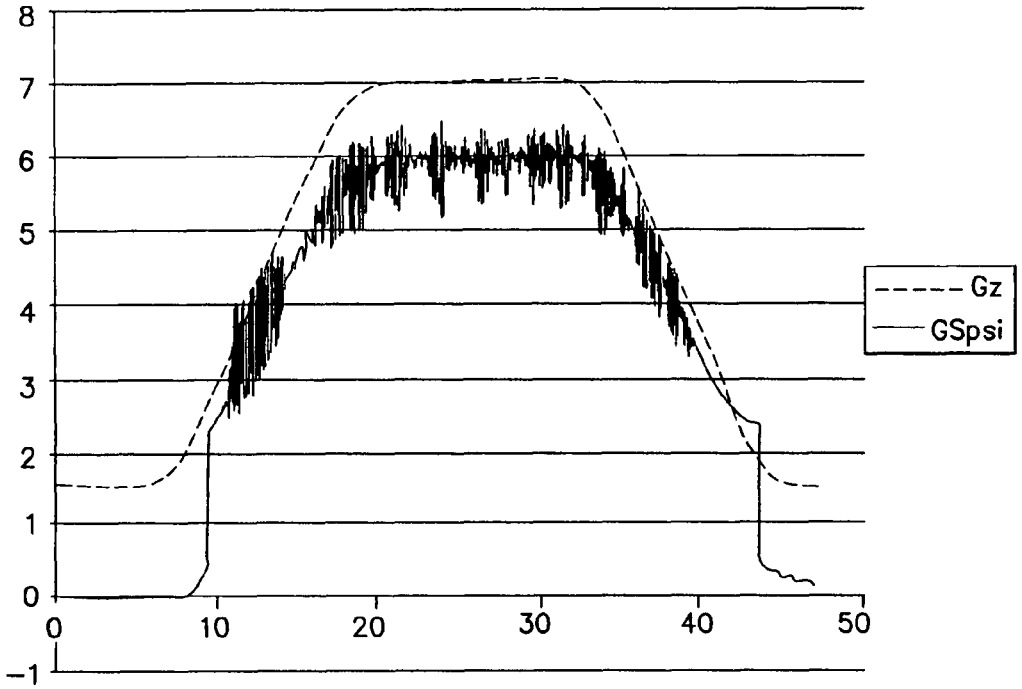
Figure 8J:
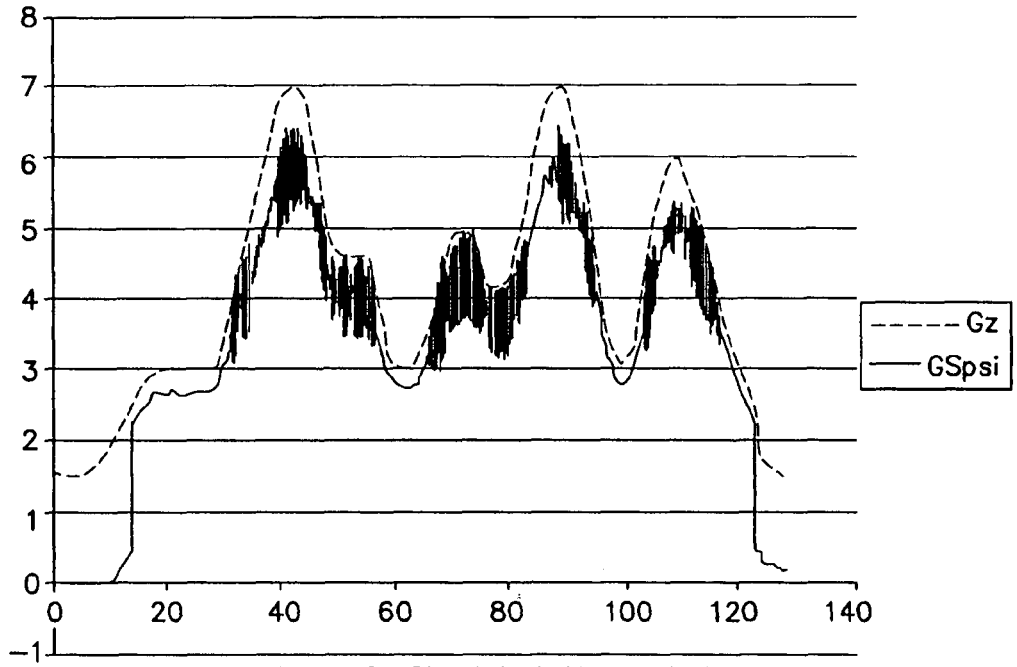
Figure 8K:
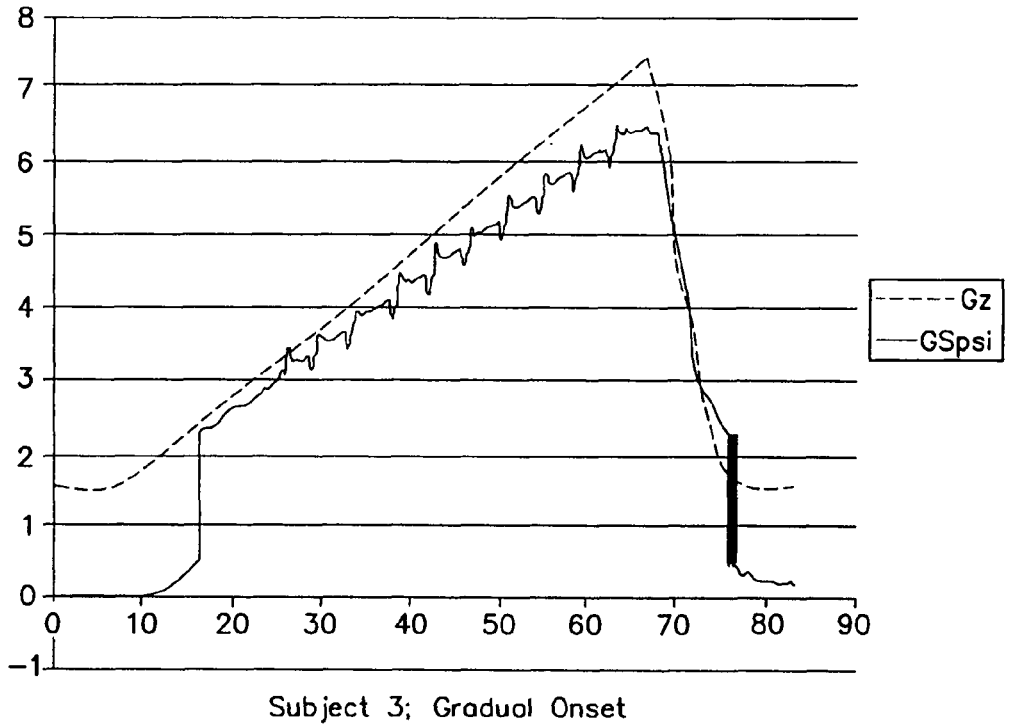
Figure 8L:
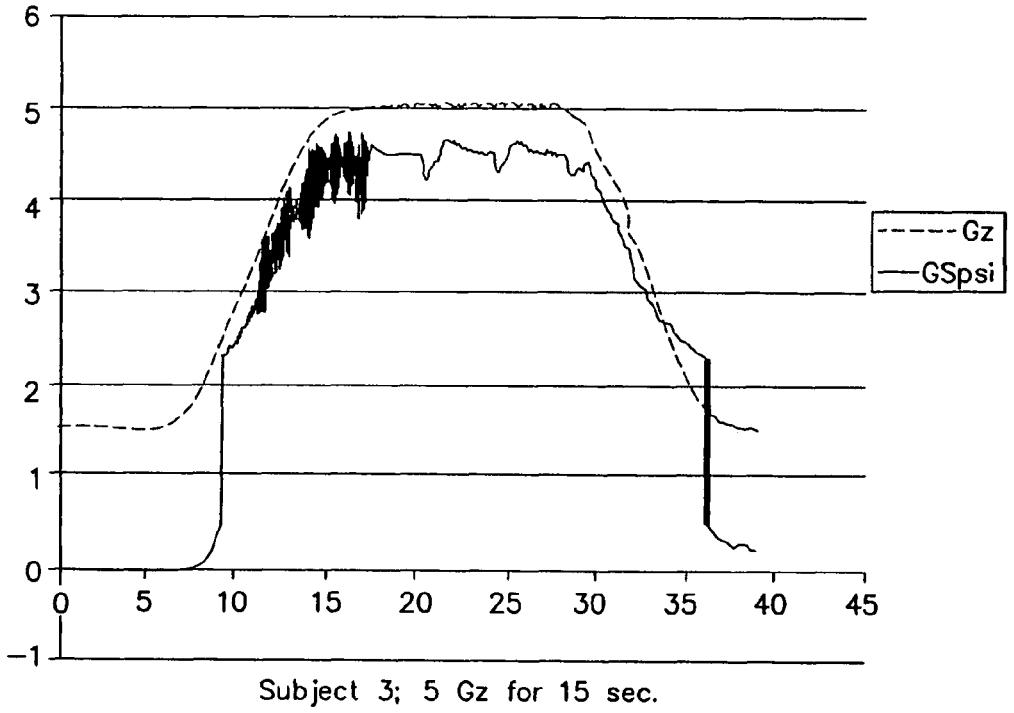
Figure 8M:
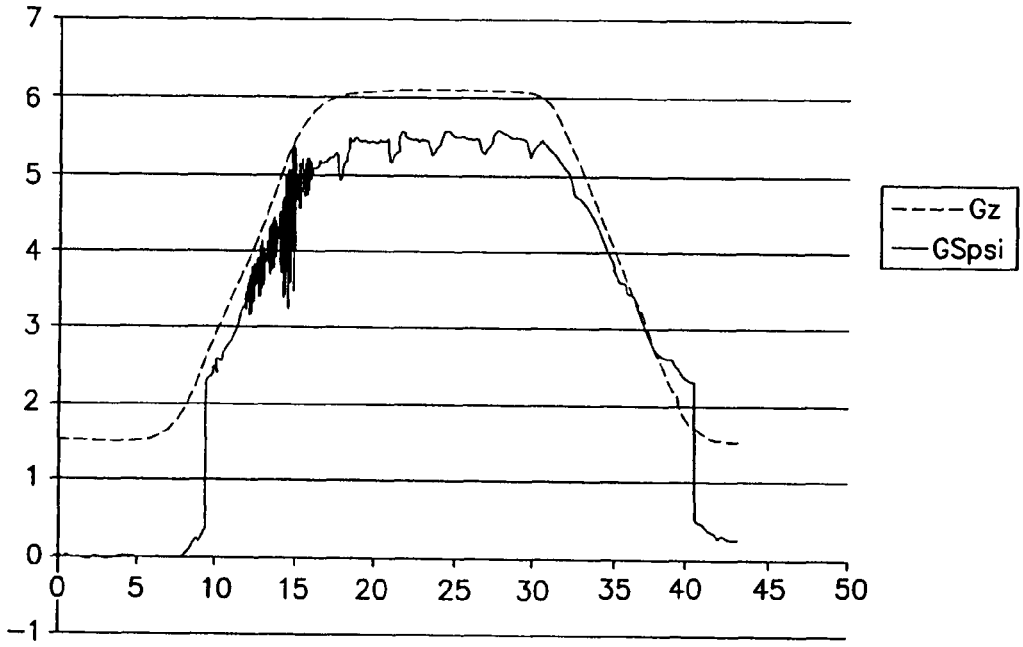
Figure 8N:
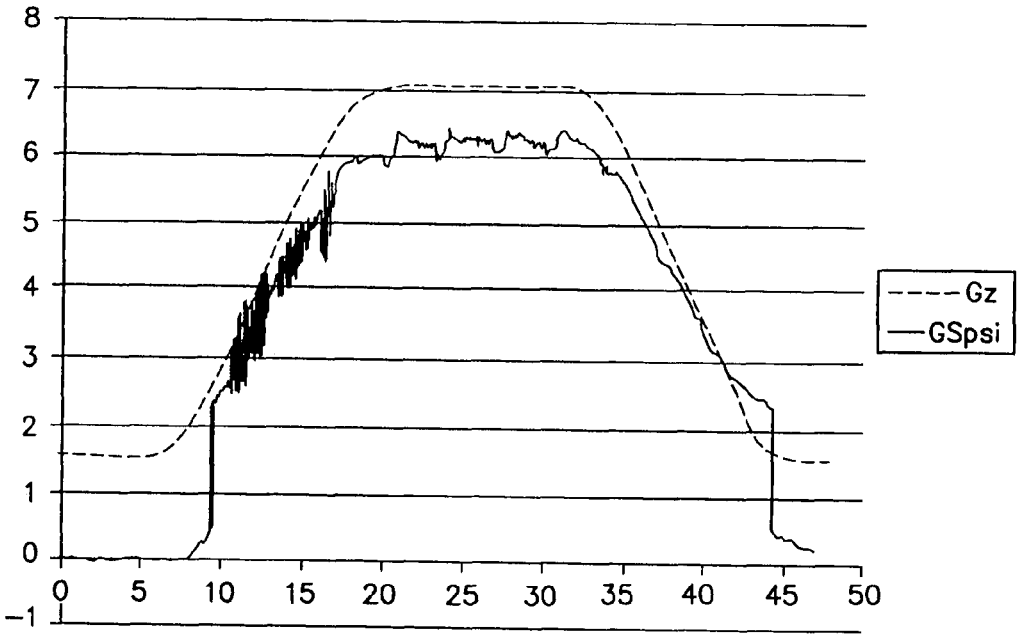
Figure 80:
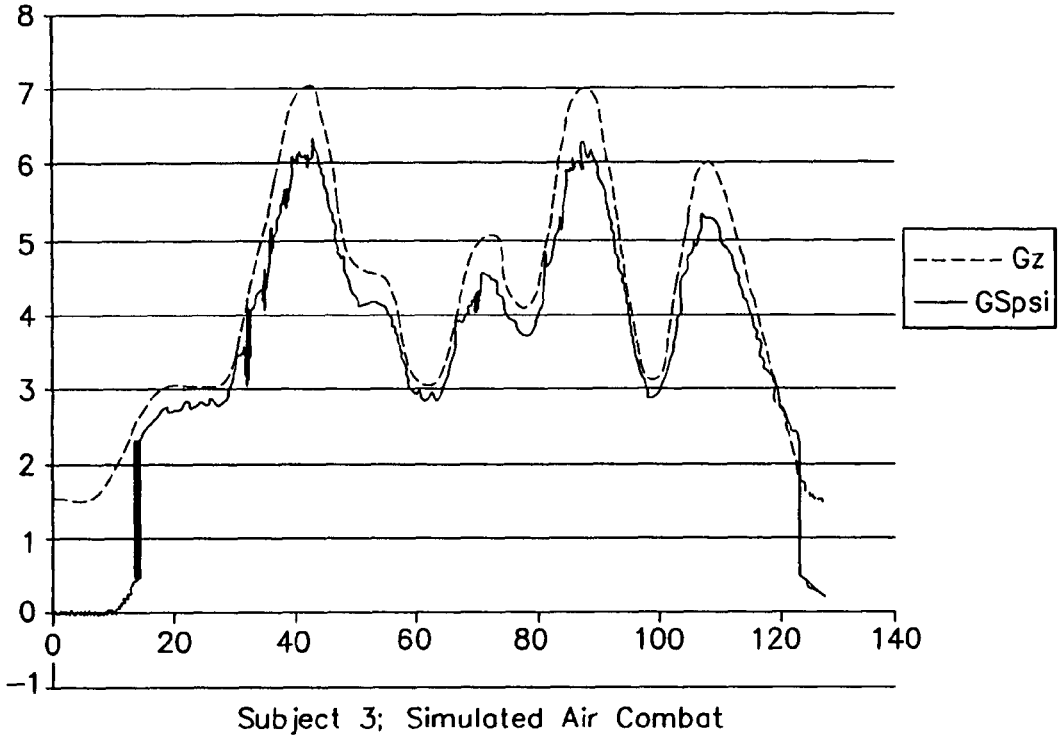
Figure 8P:
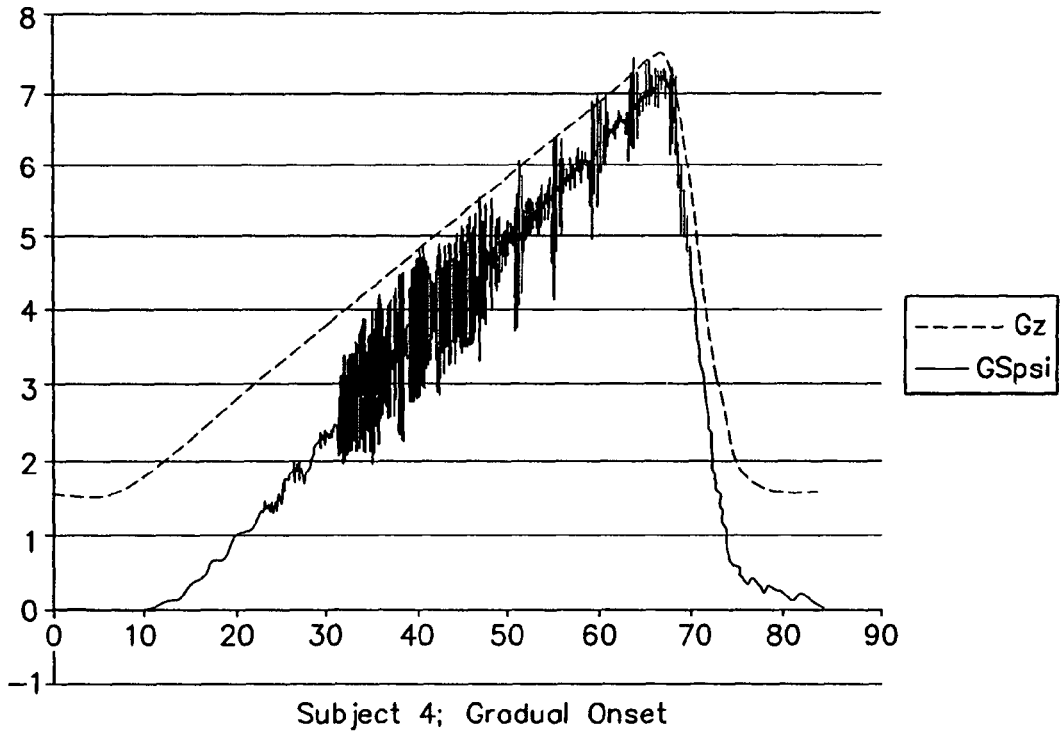
Figure 8Q:
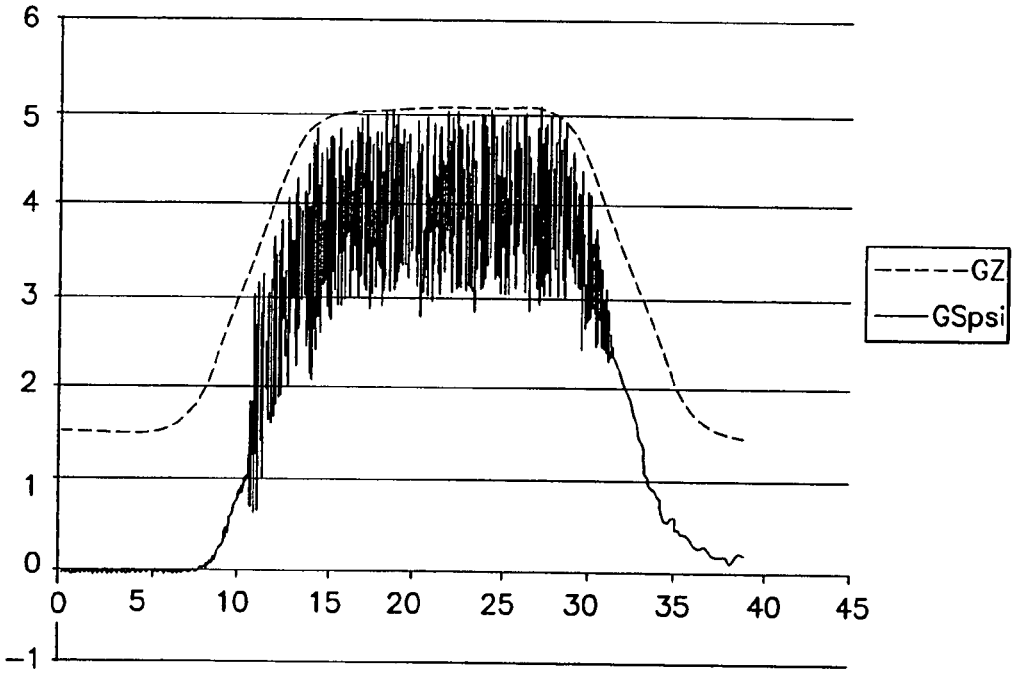
Figure 8R:
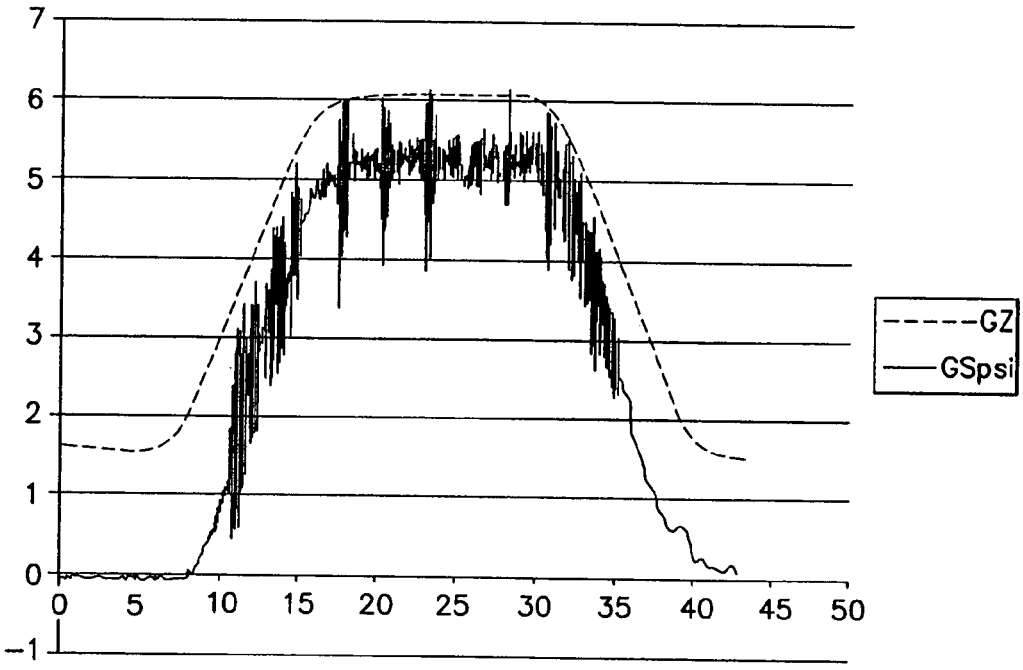
Figure 8S:
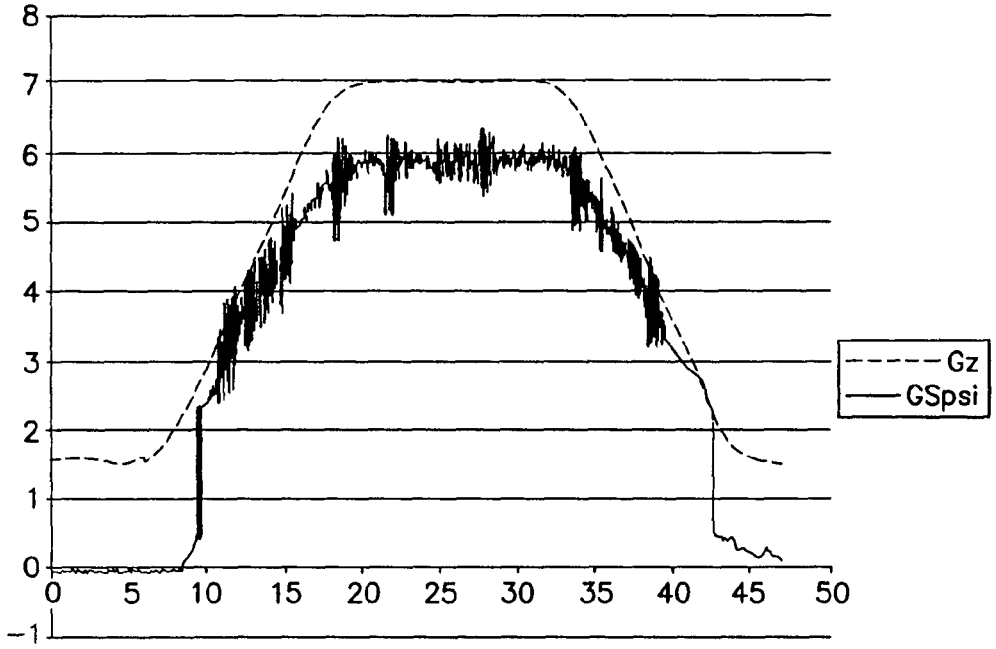
Figure 8T:
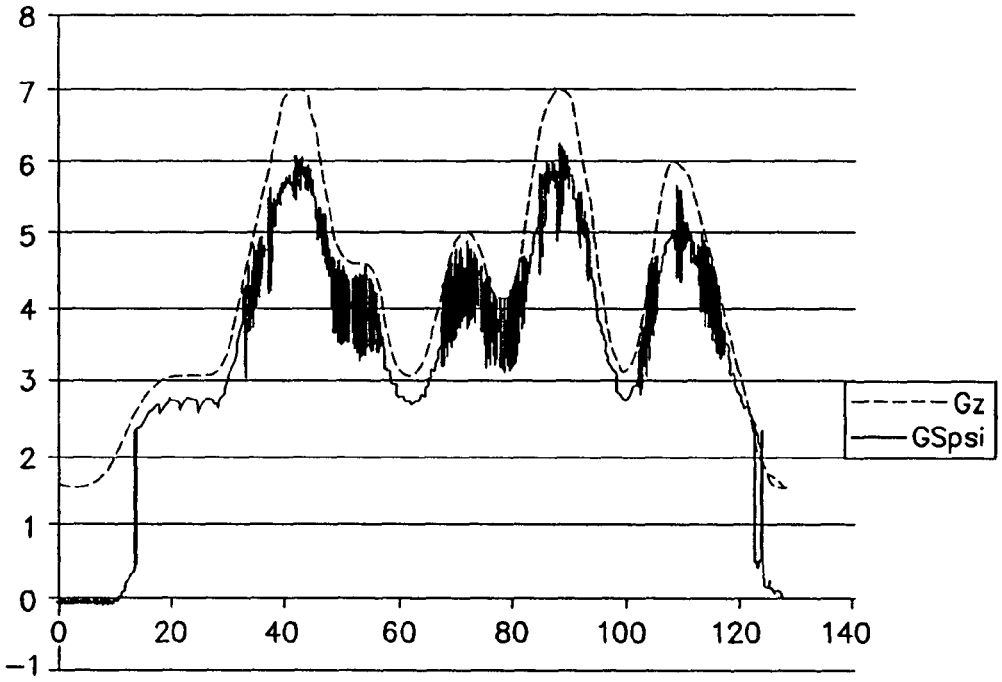

In each experimental run, a subject wore one of the two prototype multifunctional layers. Data collected for each of the four subjects during each of the five acceleration scenarios is presented in FIGS. 8A through 8T. Both prototype multifunctional layers sustained some damage, mainly tearing, in all but those trials associated with test Subject 1, mainly due to inexact fit and prototype quality hardware. The damaged multifunctional layers continued to provide protection. Chatter was detected in all experimental runs between 3 and 5 Gz.

In all instances, verbal feedback by the test subject was positive. There was no serious breach of protection and no loss of consciousness throughout. The counter-pressure of the bladders was strong throughout as they were easy to push against. Throughout the simulations, the curves of the pressure within the bladder generally followed the G-curves indicating that the bladders were capable of withstanding the applied pressures.

EXAMPLE 2

Quantitative Performance of an Integrated Ventilation System

Figure 9:
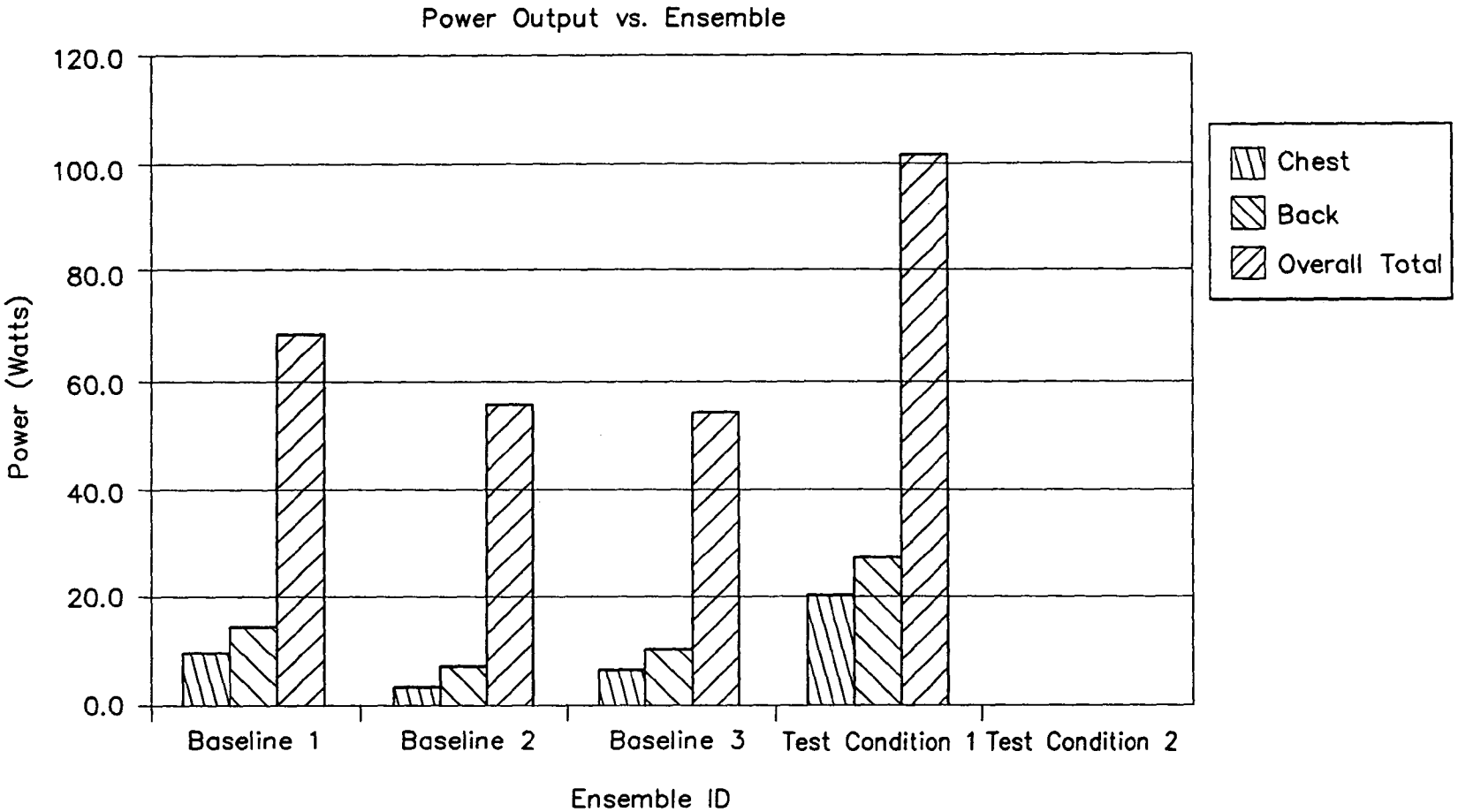
FIG. 9 presents power output data collected during quantitative analysis of an integrated ventilation system in accordance with one or more embodiments of the present invention.

Thermal manikin testing was conducted on a cooling vest including an integrated ventilation system in accordance with one or more embodiments of the present invention. The ventilation system was constructed and arranged in accordance with the description presented above of ventilation system 130 of liner 100. The chamber conditions were maintained at a temperature of 35 degrees Celsius and a relative humidity of 50 percent. The thermal manikin included power sensors in the chest and back regions. Five runs were conducted. In each run, the amount of power required to maintain the thermal manikin skin temperature at 35 degrees Celsius was monitored. The data is summarized in FIG. 9.

A baseline test 1 was conducted with the thermal manikin dressed in cotton skin and a chemical suit. A baseline test 2 was conducted with the thermal manikin dressed in cotton skin, a chemical suit, and body armor. A baseline test 3 was conducted with the thermal manikin dressed in cotton skin, a chemical suit and the cooling vest in "off" mode. A test condition 1 run was conducted with the thermal manikin wearing cotton skin, a chemical suit and the cooling vest in "on" mode. In this test condition 1, the cooling vest was operating and providing ventilation so as to result in cooling of the manikin skin. No record was kept of parameters and/or data associated with a test condition 2 run.

The data indicates that the operable "cooling vest" configuration (test condition 1) resulted in increased power needed to maintain the manikin skin temperature at 35 degrees Celcius. Substantially lower amounts of required power were associated with each of the three baseline runs. Thus, it was concluded that the cooling vest was effective in providing ventilation and cooling to the manikin skin.

Other embodiments of the integrated ensemble of the present invention, and methods for its design and use, are envisioned beyond those exemplarily described herein.

As used herein, the term "plurality" refers to two or more items or components. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims.

Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Those skilled in the art should appreciate that the parameters and configurations described herein are exemplary and that actual parameters and/or configurations will depend on the specific application in which the systems and techniques of the invention are used. Those skilled in the art should also recognize, or be able to ascertain, using no more than routine experimentation, equivalents to the specific embodiments of the invention. It is therefore to be understood that the embodiments described herein are presented by way of example only and that, within the scope of the appended claims and equivalents thereto, the invention may be practiced otherwise than as specifically described.

What is claimed is:

1. An integrated protective ensemble, comprising:

a substantially waterproof liner having at least a torso portion, the liner comprising a closure system oriented substantially diagonally across the torso portion, constructed and arranged to facilitate dressing and removal; and a shell constructed and arranged to be worn in cooperation with the substantially waterproof liner, the shell having at least a torso portion and comprising:

a storage system integrated on the torso portion, constructed and arranged to facilitate access to stored items;

an integrated casing system constructed and arranged within the shell to provide conditioning for a body; and a shaping system constructed and arranged to conform the shell to the body, wherein at least the shell is constructed from a substantially flame resistant material.

2. The ensemble of claim 1, wherein the liner further comprises an integrated ventilation system, constructed and arranged to direct airflow substantially parallel to the body.

3. The ensemble of claim 1, wherein the integrated casing system of the shell is further constructed and arranged to provide acceleration protection for the body.

4. The ensemble of claim 1, wherein the liner further comprises a neck seal coupled to the torso portion.

5. The ensemble of claim 4, wherein the liner further comprises at least one wrist seal coupled to an arm portion of the liner.

6. The ensemble of claim 1, wherein the liner is constructed from a substantially elastic material.

7. The ensemble of claim 6, wherein the liner is constructed from a wicking material.

8. The ensemble of claim 1, wherein the closure system of the liner is configured to operate from a shoulder to a lower mid-torso region of the liner in a generally S-shaped course.

9. The ensemble of claim 1, wherein the liner is constructed from a substantially insulative material.

10. The ensemble of claim 1, wherein the liner further comprises protection for at least one extremity of the body.

11. The ensemble of claim 1, wherein the liner is coated with a substantially waterproof membrane.

12. The ensemble of claim 1, wherein the shell further comprises a closure system.

13. The ensemble of claim 1, wherein the storage system comprises at least one storage feature based on a pull-out platform design.

14. The ensemble of claim 1, wherein the shell further comprises at least one articulated joint.

15. The ensemble of claim 14, wherein the shell further comprises at least one raglan sleeve.

16. The ensemble of claim 14, wherein the shell further comprises at least one stretch panel constructed and arranged to enhance mobility.

17. The ensemble of claim 1, wherein the shell further comprises a substantially raised collar.

18. The ensemble of claim 1, wherein the casing system comprises a perforated sheath.

19. The ensemble of claim 18, wherein the perforated sheath defines flat or piped ribbing.

20. The ensemble of claim 3, wherein the casing system comprises one or more counter-pressure bladders.

21. The ensemble of claim 12, wherein the closure system of the shell comprises a first closure mechanism configured to operate along a side of the torso portion of the shell.

22. The ensemble of claim 21, wherein the closure system of the shell further comprises a second closure mechanism configured to operate between a neck and a shoulder region of the shell.

23. The ensemble of claim 1, wherein the shaping system comprises at least one shaping mechanism constructed and arranged to operate with a single motion.

24. The ensemble of claim 23, wherein the at least one shaping mechanism comprises at least one lacing element.

25. An integrated protective ensemble, comprising:

a first multifunctional layer comprising an integrated ventilation system, constructed and arranged to direct airflow substantially parallel to a body; and a second multifunctional layer constructed and arranged to be worn in cooperation with the first layer, the second layer having at least a torso portion and comprising:

an integrated casing system constructed and arranged within the second layer to provide conditioning and acceleration protection for the body, wherein at least the second layer is constructed from a substantially flame resistant material.

26. The ensemble of claim 25, wherein the second layer further comprises a shaping system constructed and arranged to conform the second layer to the body.

27. The ensemble of claim 25, wherein the second layer further comprises a storage system integrated on the torso portion, constructed and arranged to facilitate access to stored items.

28. The ensemble of claim 25, wherein the second layer further comprises a closure system.

29. The ensemble of claim 27, wherein the storage system comprises at least one storage feature based on a pull-out platform design.

30. The ensemble of claim 25, wherein the second layer further comprises at least one articulated joint.

31. The ensemble of claim 30, wherein the second layer further comprises at least one raglan sleeve.

32. The ensemble of claim 25, wherein the second layer further comprises a substantially raised collar.

33. The ensemble of claim 25, wherein the second layer further comprises at least one stretch panel constructed and arranged to enhance mobility.

34. The ensemble of claim 25, wherein the casing system comprises a perforated sheath.

35. The ensemble of claim 34, wherein the perforated sheath defines flat or piped ribbing.

36. The ensemble of claim 25, wherein the casing system comprises one or more counter-pressure bladders.

37. The ensemble of claim 28, wherein the closure system of the second layer comprises a first closure mechanism configured to operate along a side of the torso portion of the second layer.

38. The ensemble of claim 37, wherein the closure system of the second layer further comprises a second closure mechanism configured to operate between a neck and a shoulder region of the second layer.

39. The ensemble of claim 26, wherein the shaping system comprises a fan lacing system.

* * * * *